US010019941B2

(12) United States Patent
Nathan et al.

(10) Patent No.: US 10,019,941 B2
(45) Date of Patent: Jul. 10, 2018

(54) COMPENSATION TECHNIQUE FOR LUMINANCE DEGRADATION IN ELECTRO-LUMINANCE DEVICES

(71) Applicant: Ignis Innovation Inc., Waterloo (CA)

(72) Inventors: Arokia Nathan, Cambridge (GB); Gholamreza Chaji, Waterloo (CA); Shahin Jafarabadiashtiani, Waterloo (CA)

(73) Assignee: Ignis Innovation Inc., Waterloo (CA)

( * ) Notice: Subject to any disclaimer, the term of this patent is extended or adjusted under 35 U.S.C. 154(b) by 507 days.

(21) Appl. No.: 14/266,901

(22) Filed: May 1, 2014

(65) Prior Publication Data

US 2014/0232623 A1 Aug. 21, 2014

Related U.S. Application Data

(63) Continuation of application No. 12/965,610, filed on Dec. 10, 2010, now Pat. No. 8,749,595, which is a (Continued)

(30) Foreign Application Priority Data

Sep. 13, 2005 (CA) ..... 2518276

(51) Int. Cl.
*G09G 3/3233* (2016.01)

(52) U.S. Cl.
CPC ... *G09G 3/3233* (2013.01); *G09G 2300/0417* (2013.01); *G09G 2300/0809* (2013.01); (Continued)

(58) Field of Classification Search
CPC ... G09G 2300/0417; G09G 2300/0809; G09G 2300/0819; G09G 2300/0842; (Continued)

(56) References Cited

U.S. PATENT DOCUMENTS 3,506,851 A 4/1970 Polkinghorn et al.
3,774,055 A 11/1973 Bapat et al.
(Continued)

FOREIGN PATENT DOCUMENTS

CA 1 294 034 1/1992
CA 2 109 951 11/1992
(Continued)

OTHER PUBLICATIONS

Ahnood et al.: "Effect of threshold voltage instability on field effect mobility in thin film transistors deduced from constant current measurements"; dated Aug. 2009.
(Continued)

*Primary Examiner* — Tony Davis
(74) *Attorney, Agent, or Firm* — Nixon Peabody LLP

(57) ABSTRACT

A method and system for compensation for luminance degradation in electro-luminance devices is provided. The system includes a pixel circuit having a light emitting device, a storage capacitor, a plurality of transistors, and control signal lines to operate the pixel circuit. The storage capacitor is connected or disconnected to the transistor and a signal line(s) when programming and driving the pixel circuit.

13 Claims, 10 Drawing Sheets

Related U.S. Application Data continuation of application No. 11/519,338, filed on Sep. 12, 2006, now Pat. No. 8,188,946.

(52) U.S. Cl.
CPC ..... *G09G 2300/0819* (2013.01); *G09G 2300/0842* (2013.01); *G09G 2300/0861* (2013.01); *G09G 2310/0251* (2013.01); *G09G 2320/0252* (2013.01); *G09G 2320/043* (2013.01); *G09G 2320/045* (2013.01)

(58) Field of Classification Search
CPC ... G09G 2300/0861; G09G 2310/0251; G09G 2320/0252; G09G 2320/043; G09G 2320/045; G09G 3/3233
USPC ..... 345/204, 76, 82
See application file for complete search history.

(56) References Cited

U.S. PATENT DOCUMENTS 4,090,096 A 5/1978 Nagami
4,160,934 A 7/1979 Kirsch
4,354,162 A 10/1982 Wright
4,943,956 A 7/1990 Noro
4,996,523 A 2/1991 Bell et al.
5,153,420 A 10/1992 Hack et al.
5,198,803 A 3/1993 Shie et al.
5,204,661 A 4/1993 Hack et al.
5,266,515 A 11/1993 Robb et al.
5,489,918 A 2/1996 Mosier
5,498,880 A 3/1996 Lee et al.
5,557,342 A 9/1996 Eto et al.
5,572,444 A 11/1996 Lentz et al.
5,589,847 A 12/1996 Lewis
5,619,033 A 4/1997 Weisfield
5,648,276 A 7/1997 Hara et al.
5,670,973 A 9/1997 Bassetti et al.
5,691,783 A 11/1997 Numao et al.
5,714,968 A 2/1998 Ikeda
5,723,950 A 3/1998 Wei et al.
5,744,824 A 4/1998 Kousai et al.
5,745,660 A 4/1998 Kolpatzik et al.
5,748,160 A 5/1998 Shieh et al.
5,815,303 A 9/1998 Berlin
5,870,071 A 2/1999 Kawahata
5,874,803 A 2/1999 Garbuzov et al.
5,880,582 A 3/1999 Sawada
5,903,248 A 5/1999 Irwin
5,917,280 A 6/1999 Burrows et al.
5,923,794 A 7/1999 McGrath et al.
5,945,972 A 8/1999 Okumura et al.
5,949,398 A 9/1999 Kim
5,952,789 A 9/1999 Stewart et al.
5,952,991 A 9/1999 Akiyama et al.
5,982,104 A 11/1999 Sasaki et al.
5,990,629 A 11/1999 Yamada et al.
6,023,259 A 2/2000 Howard et al.
6,069,365 A 5/2000 Chow et al.
6,091,203 A 7/2000 Kawashima et al.
6,097,360 A 8/2000 Holloman
6,144,222 A 11/2000 Ho
6,177,915 B1 1/2001 Beeteson et al.
6,229,506 B1 5/2001 Dawson et al.
6,229,508 B1 * 5/2001 Kane ..... 345/82
6,246,180 B1 6/2001 Nishigaki
6,252,248 B1 6/2001 Sano et al.
6,259,424 B1 7/2001 Kurogane
6,262,589 B1 7/2001 Tamukai
6,271,825 B1 8/2001 Greene et al.
6,288,696 B1 9/2001 Holloman
6,304,039 B1 10/2001 Appelberg et al.
6,307,322 B1 10/2001 Dawson et al.
6,310,962 B1 10/2001 Chung et al.
6,320,325 B1 11/2001 Cok et al.
6,323,631 B1 11/2001 Juang
6,356,029 B1 3/2002 Hunter
6,373,454 B1 4/2002 Knapp et al.
6,392,617 B1 5/2002 Gleason
6,414,661 B1 7/2002 Shen et al.
6,417,825 B1 7/2002 Stewart et al.
6,433,488 B1 8/2002 Bu
6,437,106 B1 8/2002 Stoner et al.
6,445,369 B1 9/2002 Yang et al.
6,475,845 B2 11/2002 Kimura
6,501,098 B2 12/2002 Yamazaki
6,501,466 B1 12/2002 Yamagishi et al.
6,518,962 B2 2/2003 Kimura et al.
6,522,315 B2 2/2003 Ozawa et al.
6,525,683 B1 2/2003 Gu
6,531,827 B2 3/2003 Kawashima
6,542,138 B1 4/2003 Shannon et al.
6,555,420 B1 4/2003 Yamazaki
6,580,408 B1 6/2003 Bae et al.
6,580,657 B2 6/2003 Sanford et al.
6,583,398 B2 6/2003 Harkin
6,583,775 B1 6/2003 Sekiya et al.
6,594,606 B2 7/2003 Everitt
6,618,030 B2 9/2003 Kane et al.
6,639,244 B1 10/2003 Yamazaki et al.
6,668,645 B1 12/2003 Gilmour et al.
6,677,713 B1 1/2004 Sung
6,680,580 B1 1/2004 Sung
6,687,266 B1 2/2004 Ma et al.
6,690,000 B1 2/2004 Muramatsu et al.
6,690,344 B1 2/2004 Takeuchi et al.
6,693,388 B2 2/2004 Oomura
6,693,610 B2 2/2004 Shannon et al.
6,697,057 B2 2/2004 Koyama et al.
6,720,942 B2 4/2004 Lee et al.
6,724,151 B2 4/2004 Yoo
6,734,636 B2 5/2004 Sanford et al.
6,738,034 B2 5/2004 Kaneko et al.
6,738,035 B1 5/2004 Fan
6,753,655 B2 6/2004 Shih et al.
6,753,834 B2 6/2004 Mikami et al.
6,756,741 B2 6/2004 Li
6,756,952 B1 6/2004 Decaux et al.
6,756,985 B1 6/2004 Furuhashi et al.
6,771,028 B1 8/2004 Winters
6,777,712 B2 8/2004 Sanford et al.
6,777,888 B2 8/2004 Kondo
6,781,567 B2 8/2004 Kimura
6,806,497 B2 10/2004 Jo
6,806,638 B2 10/2004 Lin et al.
6,806,857 B2 10/2004 Sempel et al.
6,809,706 B2 10/2004 Shimoda
6,815,975 B2 11/2004 Nara et al.
6,828,950 B2 12/2004 Koyama
6,853,371 B2 2/2005 Miyajima et al.
6,859,193 B1 2/2005 Yumoto
6,873,117 B2 3/2005 Ishizuka
6,876,346 B2 4/2005 Anzai et al.
6,885,356 B2 4/2005 Hashimoto
6,900,485 B2 5/2005 Lee
6,903,734 B2 6/2005 Eu
6,909,243 B2 6/2005 Inukai
6,909,419 B2 6/2005 Zavracky et al.
6,911,960 B1 6/2005 Yokoyama
6,911,964 B2 6/2005 Lee et al.
6,914,448 B2 7/2005 Jinno
6,919,871 B2 7/2005 Kwon
6,924,602 B2 8/2005 Komiya
6,937,215 B2 8/2005 Lo
6,937,220 B2 8/2005 Kitaura et al.
6,940,214 B1 9/2005 Komiya et al.
6,943,500 B2 9/2005 LeChevalier
6,947,022 B2 9/2005 McCartney
6,954,194 B2 10/2005 Matsumoto et al.
6,956,547 B2 10/2005 Bae et al.
6,975,142 B2 12/2005 Azami et al.
6,975,332 B2 12/2005 Arnold et al.
6,995,510 B2 2/2006 Murakami et al.
6,995,519 B2 2/2006 Arnold et al.

(56) References Cited

U.S. PATENT DOCUMENTS 7,023,408 B2 4/2006 Chen et al.
7,027,015 B2 4/2006 Booth, Jr. et al.
7,027,078 B2 4/2006 Reihl
7,034,793 B2 4/2006 Sekiya et al.
7,038,392 B2 5/2006 Libsch et al.
7,057,359 B2 6/2006 Hung et al.
7,061,451 B2 6/2006 Kimura
7,064,733 B2 6/2006 Cok et al.
7,071,932 B2 7/2006 Libsch et al.
7,088,051 B1 8/2006 Cok
7,088,052 B2 8/2006 Kimura
7,102,378 B2 9/2006 Kuo et al.
7,106,285 B2 9/2006 Naugler
7,112,820 B2 9/2006 Change et al.
7,116,058 B2 10/2006 Lo et al.
7,119,493 B2 10/2006 Fryer et al.
7,122,835 B1 10/2006 Ikeda et al.
7,127,380 B1 10/2006 Iverson et al.
7,129,914 B2 10/2006 Knapp et al.
7,164,417 B2 1/2007 Cok
7,193,589 B2 3/2007 Yoshida et al.
7,224,332 B2 5/2007 Cok
7,227,519 B1 6/2007 Kawase et al.
7,245,277 B2 7/2007 Ishizuka
7,248,236 B2 7/2007 Nathan et al.
7,262,753 B2 8/2007 Tanghe et al.
7,274,363 B2 9/2007 Ishizuka et al.
7,310,092 B2 12/2007 Imamura
7,315,295 B2 1/2008 Kimura
7,321,348 B2 1/2008 Cok et al.
7,339,560 B2 3/2008 Sun
7,355,574 B1 4/2008 Leon et al.
7,358,941 B2 4/2008 Ono et al.
7,368,868 B2 5/2008 Sakamoto
7,411,571 B2 8/2008 Huh
7,414,600 B2 8/2008 Nathan et al.
7,423,617 B2 9/2008 Giraldo et al.
7,474,285 B2 1/2009 Kimura
7,502,000 B2 3/2009 Yuki et al.
7,528,812 B2 5/2009 Tsuge et al.
7,535,449 B2 5/2009 Miyazawa
7,554,512 B2 6/2009 Steer
7,569,849 B2 8/2009 Nathan et al.
7,576,718 B2 8/2009 Miyazawa
7,580,012 B2 8/2009 Kim et al.
7,589,707 B2 9/2009 Chou
7,609,239 B2 10/2009 Chang
7,619,594 B2 11/2009 Hu
7,619,597 B2 11/2009 Nathan et al.
7,633,470 B2 12/2009 Kane
7,656,370 B2 2/2010 Schneider et al.
7,800,558 B2 9/2010 Routley et al.
7,800,565 B2 * 9/2010 Nathan et al. ..... 345/82
7,847,764 B2 12/2010 Cok et al.
7,859,492 B2 12/2010 Kohno
7,868,859 B2 1/2011 Tomida et al.
7,876,294 B2 1/2011 Sasaki et al.
7,924,249 B2 4/2011 Nathan et al.
7,932,883 B2 4/2011 Klompenhouwer et al.
7,969,390 B2 6/2011 Yoshida
7,978,187 B2 7/2011 Nathan et al.
7,994,712 B2 8/2011 Sung et al.
8,026,876 B2 9/2011 Nathan et al.
8,049,420 B2 11/2011 Tamura et al.
8,077,123 B2 12/2011 Naugler, Jr.
8,115,707 B2 2/2012 Nathan et al.
8,208,084 B2 6/2012 Lin
8,223,177 B2 7/2012 Nathan et al.
8,232,939 B2 7/2012 Nathan et al.
8,259,044 B2 9/2012 Nathan et al.
8,264,431 B2 9/2012 Bulovic et al.
8,279,143 B2 10/2012 Nathan et al.
8,339,386 B2 12/2012 Leon et al.
2001/0002703 A1 6/2001 Koyama
2001/0009283 A1 7/2001 Arao et al.
2001/0024181 A1 9/2001 Kubota
2001/0024186 A1 9/2001 Kane et al.
2001/0026257 A1 10/2001 Kimura
2001/0026725 A1 10/2001 Petteruti et al.
2001/0030323 A1 10/2001 Ikeda
2001/0035863 A1 11/2001 Kimura
2001/0040541 A1 11/2001 Yoneda et al.
2001/0043173 A1 11/2001 Troutman
2001/0045929 A1 11/2001 Prache
2001/0052606 A1 12/2001 Sempel et al.
2001/0052940 A1 12/2001 Hagihara et al.
2002/0000576 A1 1/2002 Inukai
2002/0011796 A1 1/2002 Koyama
2002/0011799 A1 1/2002 Kimura
2002/0012057 A1 1/2002 Kimura
2002/0014851 A1 2/2002 Tai et al.
2002/0018034 A1 2/2002 Ohki et al.
2002/0030190 A1 3/2002 Ohtani et al.
2002/0047565 A1 4/2002 Nara et al.
2002/0052086 A1 5/2002 Maeda
2002/0067134 A1 6/2002 Kawashima
2002/0084463 A1 7/2002 Sanford et al.
2002/0101172 A1 8/2002 Bu
2002/0105279 A1 8/2002 Kimura
2002/0117722 A1 8/2002 Osada et al.
2002/0122308 A1 9/2002 Ikeda
2002/0158587 A1 10/2002 Komiya
2002/0158666 A1 10/2002 Azami et al.
2002/0158823 A1 10/2002 Zavracky et al.
2002/0167474 A1 11/2002 Everitt
2002/0180369 A1 12/2002 Koyama
2002/0180721 A1 12/2002 Kimura et al.
2002/0181276 A1 12/2002 Yamazaki
2002/0186214 A1 12/2002 Siwinski
2002/0190924 A1 12/2002 Asano et al.
2002/0190971 A1 12/2002 Nakamura et al.
2002/0195967 A1 12/2002 Kim et al.
2002/0195968 A1 * 12/2002 Sanford et al. ..... 315/169.3
2003/0020413 A1 1/2003 Oomura
2003/0030603 A1 2/2003 Shimoda
2003/0043088 A1 3/2003 Booth et al.
2003/0057895 A1 3/2003 Kimura
2003/0058226 A1 3/2003 Bertram et al.
2003/0062524 A1 4/2003 Kimura
2003/0063081 A1 4/2003 Kimura et al.
2003/0071821 A1 4/2003 Sundahl et al.
2003/0076048 A1 4/2003 Rutherford
2003/0090447 A1 5/2003 Kimura
2003/0090481 A1 5/2003 Kimura
2003/0107560 A1 6/2003 Yumoto et al.
2003/0111966 A1 6/2003 Mikami et al.
2003/0122745 A1 7/2003 Miyazawa
2003/0122813 A1 7/2003 Ishizuki et al.
2003/0142088 A1 7/2003 LeChevalier
2003/0151569 A1 8/2003 Lee et al.
2003/0156101 A1 8/2003 Le Chevalier
2003/0174152 A1 9/2003 Noguchi
2003/0179626 A1 9/2003 Sanford et al.
2003/0185438 A1 10/2003 Osawa et al.
2003/0197663 A1 10/2003 Lee et al.
2003/0210256 A1 11/2003 Mori et al.
2003/0230141 A1 12/2003 Gilmour et al.
2003/0230980 A1 12/2003 Forrest et al.
2003/0231148 A1 12/2003 Lin et al.
2004/0032382 A1 2/2004 Cok et al.
2004/0041750 A1 * 3/2004 Abe ..... 345/76
2004/0066357 A1 4/2004 Kawasaki
2004/0070557 A1 4/2004 Asano et al.
2004/0070565 A1 4/2004 Nayar et al.
2004/0090186 A1 5/2004 Kanauchi et al.
2004/0090400 A1 5/2004 Yoo
2004/0095297 A1 5/2004 Libsch et al.
2004/0100427 A1 5/2004 Miyazawa
2004/0108518 A1 6/2004 Jo
2004/0135749 A1 7/2004 Kondakov et al.
2004/0140982 A1 7/2004 Pate
2004/0145547 A1 * 7/2004 Oh ..... 345/76
2004/0150592 A1 8/2004 Mizukoshi et al.
2004/0150594 A1 8/2004 Koyama et al.

(56) References Cited

U.S. PATENT DOCUMENTS

2004/0150595 A1 8/2004 Kasai
2004/0155841 A1 8/2004 Kasai
2004/0174347 A1 9/2004 Sun et al.
2004/0174349 A1* 9/2004 Libsch et al. ..... 345/204
2004/0174354 A1 9/2004 Ono et al.
2004/0178743 A1 9/2004 Miller et al.
2004/0183759 A1 9/2004 Stevenson et al.
2004/0196275 A1 10/2004 Hattori
2004/0207615 A1 10/2004 Yumoto
2004/0227697 A1 11/2004 Mori
2004/0239596 A1 12/2004 Ono et al.
2004/0252089 A1 12/2004 Ono et al.
2004/0257313 A1 12/2004 Kawashima et al.
2004/0257353 A1 12/2004 Imamura et al.
2004/0257355 A1 12/2004 Naugler
2004/0263437 A1 12/2004 Hattori
2004/0263444 A1 12/2004 Kimura
2004/0263445 A1 12/2004 Inukai et al.
2004/0263541 A1 12/2004 Takeuchi et al.
2005/0007355 A1 1/2005 Miura
2005/0007357 A1 1/2005 Yamashita et al.
2005/0007392 A1 1/2005 Kasai et al.
2005/0014891 A1 1/2005 Quinn
2005/0017650 A1 1/2005 Fryer et al.
2005/0024081 A1 2/2005 Kuo et al.
2005/0024393 A1 2/2005 Kondo et al.
2005/0030267 A1 2/2005 Tanghe et al.
2005/0057484 A1 3/2005 Diefenbaugh et al.
2005/0057580 A1 3/2005 Yamano et al.
2005/0067970 A1 3/2005 Libsch et al.
2005/0067971 A1 3/2005 Kane
2005/0068270 A1 3/2005 Awakura
2005/0068275 A1 3/2005 Kane
2005/0073264 A1 4/2005 Matsumoto
2005/0083323 A1 4/2005 Suzuki et al.
2005/0088103 A1 4/2005 Kageyama et al.
2005/0110420 A1 5/2005 Arnold et al.
2005/0110807 A1 5/2005 Chang
2005/0140598 A1 6/2005 Kim et al.
2005/0140610 A1 6/2005 Smith et al.
2005/0156831 A1 7/2005 Yamazaki et al.
2005/0162079 A1 7/2005 Sakamoto
2005/0168416 A1 8/2005 Hashimoto et al.
2005/0179626 A1 8/2005 Yuki et al.
2005/0179628 A1 8/2005 Kimura
2005/0185200 A1 8/2005 Tobol
2005/0200575 A1 9/2005 Kim et al.
2005/0206590 A1 9/2005 Sasaki et al.
2005/0212787 A1 9/2005 Noguchi et al.
2005/0219184 A1 10/2005 Zehner et al.
2005/0225683 A1* 10/2005 Nozawa ..... 348/801
2005/0248515 A1 11/2005 Naugler et al.
2005/0269959 A1 12/2005 Uchino et al.
2005/0269960 A1 12/2005 Ono et al.
2005/0280615 A1 12/2005 Cok et al.
2005/0280766 A1 12/2005 Johnson et al.
2005/0285822 A1 12/2005 Reddy et al.
2005/0285825 A1 12/2005 Eom et al.
2006/0001613 A1 1/2006 Routley et al.
2006/0007072 A1 1/2006 Choi et al.
2006/0007249 A1 1/2006 Reddy et al.
2006/0012310 A1 1/2006 Chen et al.
2006/0012311 A1 1/2006 Ogawa
2006/0022305 A1 2/2006 Yamashita
2006/0027807 A1 2/2006 Nathan et al.
2006/0030084 A1 2/2006 Young
2006/0038758 A1 2/2006 Routley et al.
2006/0038762 A1 2/2006 Chou
2006/0066533 A1 3/2006 Sato et al.
2006/0077135 A1 4/2006 Cok et al.
2006/0077142 A1 4/2006 Kwon
2006/0082523 A1 4/2006 Guo et al.
2006/0092185 A1 5/2006 Jo et al.
2006/0097628 A1 5/2006 Suh et al.
2006/0097631 A1 5/2006 Lee
2006/0103611 A1 5/2006 Choi
2006/0149493 A1 7/2006 Sambandan et al.
2006/0170623 A1 8/2006 Naugler, Jr. et al.
2006/0176250 A1 8/2006 Nathan et al.
2006/0208961 A1 9/2006 Nathan et al.
2006/0208971 A1 9/2006 Deane
2006/0214888 A1 9/2006 Schneider et al.
2006/0232522 A1 10/2006 Roy et al.
2006/0244697 A1 11/2006 Lee et al.
2006/0261841 A1 11/2006 Fish
2006/0273997 A1 12/2006 Nathan et al.
2006/0279481 A1 12/2006 Haruna et al.
2006/0284801 A1 12/2006 Yoon et al.
2006/0284895 A1 12/2006 Marcu et al.
2006/0290618 A1 12/2006 Goto
2007/0001937 A1 1/2007 Park et al.
2007/0001939 A1 1/2007 Hashimoto et al.
2007/0008251 A1 1/2007 Kohno et al.
2007/0008268 A1 1/2007 Park et al.
2007/0008297 A1 1/2007 Bassetti
2007/0057873 A1 3/2007 Uchino et al.
2007/0057874 A1 3/2007 Le Roy et al.
2007/0069998 A1 3/2007 Naugler et al.
2007/0075727 A1 4/2007 Nakano et al.
2007/0076226 A1 4/2007 Klompenhouwer et al.
2007/0080905 A1 4/2007 Takahara
2007/0080906 A1 4/2007 Tanabe
2007/0080908 A1 4/2007 Nathan et al.
2007/0097038 A1 5/2007 Yamazaki et al.
2007/0097041 A1 5/2007 Park et al.
2007/0103419 A1 5/2007 Uchino et al.
2007/0115221 A1 5/2007 Buchhauser et al.
2007/0164664 A1 7/2007 Ludwicki et al.
2007/0182671 A1 8/2007 Nathan et al.
2007/0236440 A1 10/2007 Wacyk et al.
2007/0236517 A1 10/2007 Kimpe
2007/0241999 A1 10/2007 Lin
2007/0273294 A1 11/2007 Nagayama
2007/0285359 A1 12/2007 Ono
2007/0290958 A1 12/2007 Cok
2007/0296672 A1 12/2007 Kim et al.
2008/0001525 A1 1/2008 Chao et al.
2008/0001544 A1 1/2008 Murakami et al.
2008/0030518 A1 2/2008 Higgins et al.
2008/0036708 A1 2/2008 Shirasaki
2008/0042942 A1 2/2008 Takahashi
2008/0042948 A1 2/2008 Yamashita et al.
2008/0048951 A1 2/2008 Naugler, Jr. et al.
2008/0055209 A1 3/2008 Cok
2008/0055211 A1 3/2008 Takashi
2008/0074413 A1 3/2008 Ogura
2008/0088549 A1 4/2008 Nathan et al.
2008/0088648 A1 4/2008 Nathan et al.
2008/0111766 A1 5/2008 Uchino et al.
2008/0116787 A1 5/2008 Hsu et al.
2008/0117144 A1 5/2008 Nakano et al.
2008/0150845 A1 6/2008 Masahito et al.
2008/0150847 A1 6/2008 Kim et al.
2008/0158115 A1 7/2008 Cordes et al.
2008/0158648 A1 7/2008 Cummings
2008/0198103 A1 8/2008 Toyomura et al.
2008/0211749 A1 9/2008 Weitbruch et al.
2008/0231558 A1 9/2008 Naugler
2008/0231562 A1 9/2008 Kwon
2008/0231625 A1 9/2008 Minami et al.
2008/0252223 A1 10/2008 Hirokuni et al.
2008/0252571 A1 10/2008 Hente et al.
2008/0259020 A1 10/2008 Fisekovic et al.
2008/0290805 A1 11/2008 Yamada et al.
2008/0297055 A1 12/2008 Miyake et al.
2009/0058772 A1 3/2009 Lee
2009/0109142 A1 4/2009 Hiroshi
2009/0121994 A1 5/2009 Miyata
2009/0146926 A1 6/2009 Sung et al.
2009/0160743 A1 6/2009 Tomida et al.
2009/0174628 A1 7/2009 Wang et al.
2009/0184901 A1 7/2009 Kwon
2009/0195483 A1 8/2009 Naugler, Jr. et al.
2009/0201281 A1 8/2009 Routley et al.

(56) References Cited

U.S. PATENT DOCUMENTS

| | | | |
|---|---|---|---|
| 2009/0206764 | A1 | 8/2009 | Schemmann et al. |
| 2009/0213046 | A1 | 8/2009 | Nam |
| 2009/0244046 | A1 | 10/2009 | Seto |
| 2010/0004891 | A1 | 1/2010 | Ahlers et al. |
| 2010/0039422 | A1 | 2/2010 | Seto |
| 2010/0039458 | A1 | 2/2010 | Nathan et al. |
| 2010/0060911 | A1 | 3/2010 | Marcu et al. |
| 2010/0079419 | A1 | 4/2010 | Shibusawa |
| 2010/0165002 | A1 | 7/2010 | Ahn |
| 2010/0194670 | A1 | 8/2010 | Cok |
| 2010/0207960 | A1 | 8/2010 | Kimpe et al. |
| 2010/0225630 | A1 | 9/2010 | Levey et al. |
| 2010/0251295 | A1 | 9/2010 | Amento et al. |
| 2010/0277400 | A1 | 11/2010 | Jeong |
| 2010/0315319 | A1 | 12/2010 | Cok et al. |
| 2011/0063197 | A1 | 3/2011 | Chung et al. |
| 2011/0069051 | A1 | 3/2011 | Nakamura et al. |
| 2011/0069089 | A1 | 3/2011 | Kopf et al. |
| 2011/0074750 | A1 | 3/2011 | Leon et al. |
| 2011/0149166 | A1 | 6/2011 | Botzas et al. |
| 2011/0181630 | A1 | 7/2011 | Smith et al. |
| 2011/0199395 | A1 | 8/2011 | Nathan et al. |
| 2011/0227964 | A1 | 9/2011 | Chaji et al. |
| 2011/0273399 | A1 | 11/2011 | Lee |
| 2011/0293480 | A1 | 12/2011 | Mueller |
| 2012/0056558 | A1 | 3/2012 | Toshiya et al. |
| 2012/0062565 | A1 | 3/2012 | Fuchs et al. |
| 2012/0262184 | A1 | 10/2012 | Shen |
| 2012/0299978 | A1 | 11/2012 | Chaji |
| 2013/0027381 | A1 | 1/2013 | Nathan et al. |
| 2013/0057595 | A1 | 3/2013 | Nathan et al. |
| 2013/0112960 | A1 | 5/2013 | Chaji et al. |
| 2013/0135272 | A1 | 5/2013 | Park |
| 2013/0309821 | A1 | 11/2013 | Yoo et al. |
| 2013/0321671 | A1 | 12/2013 | Cote et al. |

FOREIGN PATENT DOCUMENTS

| | | | |
|---|---|---|---|
| CA | 2 249 592 | | 7/1998 |
| CA | 2 368 386 | | 9/1999 |
| CA | 2 242 720 | | 1/2000 |
| CA | 2 354 018 | | 6/2000 |
| CA | 2 432 530 | | 7/2002 |
| CA | 2 436 451 | | 8/2002 |
| CA | 2 438 577 | | 8/2002 |
| CA | 2 463 653 | | 1/2004 |
| CA | 2 498 136 | | 3/2004 |
| CA | 2 522 396 | | 11/2004 |
| CA | 2 443 206 | | 3/2005 |
| CA | 2 472 671 | | 12/2005 |
| CA | 2 567 076 | | 1/2006 |
| CA | 2 526 782 | | 4/2006 |
| CA | 2 541 531 | | 7/2006 |
| CA | 2 550 102 | | 4/2008 |
| CA | 2 773 699 | | 10/2013 |
| CN | 1381032 | | 11/2002 |
| CN | 1448908 | | 10/2003 |
| CN | 1760945 | | 4/2006 |
| CN | 1886774 | | 12/2006 |
| CN | 102656621 | | 9/2012 |
| EP | 0 158 366 | | 10/1985 |
| EP | 1 028 471 | | 8/2000 |
| EP | 1 111 577 | | 6/2001 |
| EP | 1 130 565 | A1 | 9/2001 |
| EP | 1 194 013 | | 4/2002 |
| EP | 1 335 430 | A1 | 8/2003 |
| EP | 1 372 136 | | 12/2003 |
| EP | 1 381 019 | | 1/2004 |
| EP | 1 418 566 | | 5/2004 |
| EP | 1 429 312 | A | 6/2004 |
| EP | 145 0341 | A | 8/2004 |
| EP | 1 465 143 | A | 10/2004 |
| EP | 1 469 448 | A | 10/2004 |
| EP | 1 521 203 | A2 | 4/2005 |
| EP | 1 594 347 | | 11/2005 |
| EP | 1 784 055 | A2 | 5/2007 |
| EP | 1854338 | A1 | 11/2007 |
| EP | 1 879 169 | A1 | 1/2008 |
| EP | 1 879 172 | | 1/2008 |
| GB | 2 389 951 | | 12/2003 |
| JP | 1272298 | | 10/1989 |
| JP | 4-042619 | | 2/1992 |
| JP | 6-314977 | | 11/1994 |
| JP | 8-340243 | | 12/1996 |
| JP | 09-090405 | | 4/1997 |
| JP | 10-254410 | | 9/1998 |
| JP | 11-202295 | | 7/1999 |
| JP | 11-219146 | | 8/1999 |
| JP | 11 231805 | | 8/1999 |
| JP | 11-282419 | | 10/1999 |
| JP | 2000-056847 | | 2/2000 |
| JP | 2000-81607 | | 3/2000 |
| JP | 2001-134217 | | 5/2001 |
| JP | 2001-195014 | | 7/2001 |
| JP | 2002-055654 | | 2/2002 |
| JP | 2002-91376 | | 3/2002 |
| JP | 2002-514320 | | 5/2002 |
| JP | 2002-278513 | | 9/2002 |
| JP | 2002-333862 | | 11/2002 |
| JP | 2003-076331 | | 3/2003 |
| JP | 2003-124519 | | 4/2003 |
| JP | 2003-177709 | | 6/2003 |
| JP | 2003-271095 | | 9/2003 |
| JP | 2003-308046 | | 10/2003 |
| JP | 2003-317944 | | 11/2003 |
| JP | 2004-004675 | | 1/2004 |
| JP | 2004-145197 | | 5/2004 |
| JP | 2004-287345 | | 10/2004 |
| JP | 2005-057217 | | 3/2005 |
| JP | 2007-65015 | | 3/2007 |
| JP | 2008102335 | | 5/2008 |
| JP | 4-158570 | | 10/2008 |
| KR | 2004-0100887 | | 12/2004 |
| TW | 342486 | | 10/1998 |
| TW | 473622 | | 1/2002 |
| TW | 485337 | | 5/2002 |
| TW | 502233 | | 9/2002 |
| TW | 538650 | | 6/2003 |
| TW | 1221268 | | 9/2004 |
| TW | 1223092 | | 11/2004 |
| TW | 200727247 | | 7/2007 |
| WO | WO 1998/48403 | | 10/1998 |
| WO | WO 1999/48079 | | 9/1999 |
| WO | WO 2001/06484 | | 1/2001 |
| WO | WO 2001/27910 | A1 | 4/2001 |
| WO | WO 2001/63587 | A2 | 8/2001 |
| WO | WO 2002/067327 | A | 8/2002 |
| WO | WO 2003/001496 | A1 | 1/2003 |
| WO | WO 2003/034389 | A | 4/2003 |
| WO | WO 2003/058594 | A1 | 7/2003 |
| WO | WO 2003/063124 | | 7/2003 |
| WO | WO 2003/077231 | | 9/2003 |
| WO | WO 2004/003877 | | 1/2004 |
| WO | WO 2004/025615 | A | 3/2004 |
| WO | WO 2004/034364 | | 4/2004 |
| WO | WO 2004/047058 | | 6/2004 |
| WO | WO 2004/104975 | A1 | 12/2004 |
| WO | WO 2005/022498 | | 3/2005 |
| WO | WO 2005/022500 | A | 3/2005 |
| WO | WO 2005/029455 | | 3/2005 |
| WO | WO 2005/029456 | | 3/2005 |
| WO | WO 2005/055185 | | 6/2005 |
| WO | WO 2006/000101 | A1 | 1/2006 |
| WO | WO 2006/053424 | | 5/2006 |
| WO | WO 2006/063448 | A | 6/2006 |
| WO | WO 2006/084360 | | 8/2006 |
| WO | WO 2007/003877 | A | 1/2007 |
| WO | WO 2007/079572 | | 7/2007 |
| WO | WO 2007/120849 | A2 | 10/2007 |
| WO | WO 2009/048618 | | 4/2009 |
| WO | WO 2009/055920 | | 5/2009 |
| WO | WO 2010/023270 | | 3/2010 |
| WO | WO 2011/041224 | A1 | 4/2011 |
| WO | WO 2011/064761 | A1 | 6/2011 |

(56) References Cited

FOREIGN PATENT DOCUMENTS

| | | | |
|---|---|---|---|
| WO | WO 2011/067729 | | 6/2011 |
| WO | WO 2012/160424 | A1 | 11/2012 |
| WO | WO 2012/160471 | | 11/2012 |
| WO | WO 2012/164474 | A2 | 12/2012 |
| WO | WO 2012/164475 | A2 | 12/2012 |

OTHER PUBLICATIONS

Alexander et al.: "Pixel circuits and drive schemes for glass and elastic AMOLED displays"; dated Jul. 2005 (9 pages).
Alexander et al.: "Unique Electrical Measurement Technology for Compensation, Inspection, and Process Diagnostics of AMOLED HDTV"; dated May 2010 (4 pages).
Ashtiani et al.: "AMOLED Pixel Circuit With Electronic Compensation of Luminance Degradation"; dated Mar. 2007 (4 pages).
Chaji et al.: "A Current-Mode Comparator for Digital Calibration of Amorphous Silicon AMOLED Displays"; dated Jul. 2008 (5 pages).
Chaji et al.: "A fast settling current driver based on the CCII for AMOLED displays"; dated Dec. 2009 (6 pages).
Chaji et al.: "A Low-Cost Stable Amorphous Silicon AMOLED Display with Full V~T- and V~O~L~E~D Shift Compensation"; dated May 2007 (4 pages).
Chaji et al.: "A low-power driving scheme for a-Si:H active-matrix organic light-emitting diode displays"; dated Jun. 2005 (4 pages).
Chaji et al.: "A low-power high-performance digital circuit for deep submicron technologies"; dated Jun. 2005 (4 pages).
Chaji et al.: "A novel a-Si:H AMOLED pixel circuit based on short-term stress stability of a-Si:H TFTs"; dated Oct. 2005 (3 pages).
Chaji et al.: "A Novel Driving Scheme and Pixel Circuit for AMOLED Displays"; dated Jun. 2006 (4 pages).
Chaji et al.: "A Novel Driving Scheme for High Resolution Large-area a-Si:H AMOLED displays"; dated Aug. 2005 (3 pages).
Chaji et al.: "A Stable Voltage-Programmed Pixel Circuit for a-Si:H AMOLED Displays"; dated Dec. 2006 (12 pages).
Chaji et al.: "A Sub-μA fast-settling current-programmed pixel circuit for AMOLED displays"; dated Sep. 2007.
Chaji et al.: "An Enhanced and Simplified Optical Feedback Pixel Circuit for AMOLED Displays"; dated Oct. 2006.
Chaji et al.: "Compensation technique for DC and transient instability of thin film transistor circuits for large-area devices"; dated Aug. 2008.
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "Electrical Compensation of OLED Luminance Degradation"; dated Dec. 2007 (3 pages).
Chaji et al.: "eUTDSP: a design study of a new VLIW-based DSP architecture"; dated My 2003 (4 pages).
Chaji et al.: "Fast and Offset-Leakage Insensitive Current-Mode Line Driver for Active Matrix Displays and Sensors"; dated Feb. 2009 (8 pages).
Chaji et al.: "High Speed Low Power Adder Design With a New Logic Style: Pseudo Dynamic Logic (SDL)"; dated Oct. 2001 (4 pages).
Chaji et al.: "High-precision, fast current source for large-area current-programmed a-Si flat panels"; dated Sep. 2006 (4 pages).
Chaji et al.: "Low-Cost AMOLED Television with IGNIS Compensating Technology"; dated May 2008 (4 pages).
Chaji et al.: "Low-Cost Stable a-Si:H AMOLED Display for Portable Applications"; dated Jun. 2006 (4 pages).
Chaji et al.: "Low-Power Low-Cost Voltage-Programmed a-Si:H AMOLED Display"; dated Jun. 2008 (5 pages).
Chaji et al.: "Merged phototransistor pixel with enhanced near infrared response and flicker noise reduction for biomolecular imaging"; dated Nov. 2008 (3 pages).
Chaji et al.: "Parallel Addressing Scheme for Voltage-Programmed Active-Matrix OLED Displays"; dated May 2007 (6 pages).
Chaji et al.: "Pseudo dynamic logic (SDL): a high-speed and low-power dynamic logic family"; dated 2002 (4 pages).
Chaji et al.: "Stable a-Si:H circuits based on short-term stress stability of amorphous silicon thin film transistors"; dated May 2006 (4 pages).
Chaji et al.: "Stable Pixel Circuit for Small-Area High- Resolution a-Si:H AMOLED Displays"; dated Oct. 2008 (6 pages).
Chaji et al.: "Stable RGBW AMOLED display with OLED degradation compensation using electrical feedback"; dated Feb. 2010 (2 pages).
Chaji et al.: "Thin-Film Transistor Integration for Biomedical Imaging and AMOLED Displays"; dated 2008 (177 pages).
European Search Report for Application No. EP 01 11 22313 dated Sep. 14, 2005 (4 pages).
European Search Report for Application No. EP 04 78 6661 dated Mar. 9, 2009.
European Search Report for Application No. EP 05 75 9141 dated Oct. 30, 2009 (2 pages).
European Search Report for Application No. EP 05 81 9617 dated Jan. 30, 2009.
European Search Report for Application No. EP 06 70 5133 dated Jul. 18, 2008.
European Search Report for Application No. EP 06 72 1798 dated Nov. 12, 2009 (2 pages).
European Search Report for Application No. EP 07 71 0608.6 dated Mar. 19, 2010 (7 pages).
European Search Report for Application No. EP 07 71 9579 dated May 20, 2009.
European Search Report for Application No. EP 07 81 5784 dated Jul. 20, 2010 (2 pages).
European Search Report for Application No. EP 10 16 6143, dated Sep. 3, 2010 (2 pages).
European Search Report for Application No. EP 10 83 4294.0-1903, dated Apr. 8, 2013, (9 pages).
European Search Report for Application No. PCT/CA2006/000177 dated Jun. 2, 2006.
European Supplementary Search Report for Application No. EP 04 78 6662 dated Jan. 19, 2007 (2 pages).
Extended European Search Report for Application No. 11 73 9485.8 dated Aug. 6, 2013(14 pages).
Extended European Search Report for Application No. EP 09 73 3076.5, dated Apr. 27, (13 pages).
Extended European Search Report for Application No. EP 11 16 8677.0, dated Nov. 29, 2012, (13 page).
Extended European Search Report for Application No. EP 11 19 1641.7 dated Jul. 11, 2012 (14 pages).
Fossum, Eric R.. "Active Pixel Sensors: Are CCD's Dinosaurs?" SPIE: Symposium on Electronic Imaging. Feb. 1, 1993 (13 pages).
Goh et al., "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.
International Preliminary Report on Patentability for Application No. PCT/CA2005/001007 dated Oct. 16, 2006, 4 pages.
International Search Report for Application No. PCT/CA2004/001741 dated Feb. 21, 2005.
International Search Report for Application No. PCT/CA2004/001742, Canadian Patent Office, dated Feb. 21, 2005 (2 pages).
International Search Report for Application No. PCT/CA2005/001007 dated Oct. 18, 2005.
International Search Report for Application No. PCT/CA2005/001897, dated Mar. 21, 2006 (2 pages).
International Search Report for Application No. PCT/CA2007/000652 dated Jul. 25, 2007.
International Search Report for Application No. PCT/CA2009/000501, dated Jul. 30, 2009 (4 pages).
International Search Report for Application No. PCT/CA2009/001769, dated Apr. 8, 2010 (3 pages).
International Search Report for Application No. PCT/IB2010/055481, dated Apr. 7, 2011, 3 pages.
International Search Report for Application No. PCT/IB2010/055486, dated Apr. 19, 2011, 5 pages.
International Search Report for Application No. PCT/IB2010/055541 filed Dec. 1, 2010, dated May 26, 2011; 5 pages.

(56) References Cited

OTHER PUBLICATIONS

International Search Report for Application No. PCT/IB2011/050502, dated Jun. 27, 2011 (6 pages).
International Search Report for Application No. PCT/IB2011/051103, dated Jul. 8, 2011, 3 pages.
International Search Report for Application No. PCT/IB2011/055135, Canadian Patent Office, dated Apr. 16, 2012 (5 pages).
International Search Report for Application No. PCT/IB2012/052372, dated Sep. 12, 2012 (3 pages).
International Search Report for Application No. PCT/IB2013/054251, Canadian Intellectual Property Office, dated Sep. 11, 2013; (4 pages).
International Search Report for Application No. PCT/JP02/09668, dated Dec. 3, 2002, (4 pages).
International Written Opinion for Application No. PCT/CA2004/001742, Canadian Patent Office, dated Feb. 21, 2005 (5 pages).
International Written Opinion for Application No. PCT/CA2005/001897, dated Mar. 21, 2006 (4 pages).
International Written Opinion for Application No. PCT/CA2009/000501 dated Jul. 30, 2009 (6 pages).
International Written Opinion for Application No. PCT/IB2010/055481, dated Apr. 7, 2011, 6 pages.
International Written Opinion for Application No. PCT/IB2010/055486, dated Apr. 19, 2011, 8 pages.
International Written Opinion for Application No. PCT/IB2010/055541, dated May 26, 2011; 6 pages.
International Written Opinion for Application No. PCT/IB2011/050502, dated Jun. 27, 2011 (7 pages).
International Written Opinion for Application No. PCT/IB2011/051103, dated Jul. 8, 2011, 6 pages.
International Written Opinion for Application No. PCT/IB2011/055135, Canadian Patent Office, dated Apr. 16, 2012 (5 pages).
International Written Opinion for Application No. PCT/IB2012/052372, dated Sep. 12, 2012 (6 pages).
International Written Opinion for Application No. PCT/IB2013/054251, Canadian Intellectual Property Office, dated Sep. 11, 2013; (5 pages).
International Written Opinion for Application No. PCT/IB2014/060879, Canadian Intellectual Property Office, dated Jul. 17, 2014; (4 pages).
Jafarabadiashtiani et al.: "A New Driving Method for a-Si AMOLED Displays Based on Voltage Feedback"; dated 2005 (4 pages).
Kanicki, J., et al. "Amorphous Silicon Thin-Film Transistors Based Active-Matrix Organic Light-Emitting Displays." Asia Display: International Display Workshops, Sep. 2001 (pp. 315-318).
Karim, K. S., et al. "Amorphous Silicon Active Pixel Sensor Readout Circuit for Digital Imaging." IEEE: Transactions on Electron Devices. vol. 50, No. 1, Jan. 2003 (pp. 200-208).
Lee et al.: "Ambipolar Thin-Film Transistors Fabricated by PECVD Nanocrystalline Silicon"; dated 2006.
Lee, Wonbok: "Thermal Management in Microprocessor Chips and Dynamic Backlight Control in Liquid Crystal Displays", Ph.D. Dissertation, University of Southern California (124 pages).
Ma E Y et al.: "organic light emitting diode/thin film transistor integration for foldable displays" dated Sep. 15, 1997(4 pages).
Matsueda y et al.: "35.1: 2.5-in. AMOLED with Integrated 6-bit Gamma Compensated Digital Data Driver"; dated May 2004.
Mendes E., et al. "A High Resolution Switch-Current Memory Base Cell." IEEE: Circuits and Systems. vol. 2, Aug. 1999 (pp. 718-721).
Nathan A. et al., "Thin Film imaging technology on glass and plastic" ICM 2000, proceedings of the 12 international conference on microelectronics, dated Oct. 31, 2001 (4 pages).
Nathan et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.
Nathan et al.: "Backplane Requirements for active Matrix Organic Light Emitting Diode Displays,"; dated 2006 (16 pages).
Nathan et al.: "Call for papers second international workshop on compact thin-film transistor (TFT) modeling for circuit simulation"; dated Sep. 2009 (1 page).
Nathan et al.: "Driving schemes for a-Si and LTPS AMOLED displays"; dated Dec. 2005 (11 pages).
Nathan et al.: "Invited Paper: a-Si for AMOLED—Meeting the Performance and Cost Demands of Display Applications (Cell Phone to HDTV)"; dated 2006 (4 pages).
Office Action in Japanese patent application No. JP2006-527247 dated Mar. 15, 2010. (8 pages).
Office Action in Japanese patent application No. JP2007-545796 dated Sep. 5, 2011. (8 pages).
Office Action in Japanese patent application No. JP2012-541612 dated Jul. 15, 2014. (3 pages).
Partial European Search Report for Application No. EP 11 168 677.0, dated Sep. 22, 2011 (5 pages).
Partial European Search Report for Application No. EP 11 19 1641.7, dated Mar. 20, 2012 (8 pages).
Philipp: "Charge transfer sensing" Sensor Review, vol. 19, No. 2, Dec. 31, 1999 (Dec. 31, 1999), 10 pages.
Rafati et al.: "Comparison of a 17 b multiplier in Dual-rail domino and in Dual-rail D L (D L) logic styles"; dated 2002 (4 pages).
Safavian et al.: "3-TFT active pixel sensor with correlated double sampling readout circuit for real-time medical x-ray imaging"; dated Jun. 2006 (4 pages).
Safavian et al.: "A novel current scaling active pixel sensor with correlated double sampling readout circuit for real time medical x-ray imaging"; dated May 2007 (7 pages).
Safavian et al.: "A novel hybrid active-passive pixel with correlated double sampling CMOS readout circuit for medical x-ray imaging"; dated May 2008 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Safavian et al.: "Three-TFT image sensor for real-time digital X-ray imaging"; dated Feb. 2, 2006 (2 pages).
Search Report for Taiwan Invention Patent Application No. 093128894 dated May 1, 2012. (1 page).
Search Report for Taiwan Invention Patent Application No. 94144535 dated Nov. 1, 2012. (1 page).
Singh, et al., "Current Conveyor: Novel Universal Active Block", Samriddhi, S-JPSET vol. I, Issue 1, 2010, pp. 41-48 (12EPPT).
Smith, Lindsay I., "A tutorial on Principal Components Analysis," dated Feb. 26, 2001 (27 pages).
Spindler et al., System Considerations for RGBW OLED Displays, Journal of the SID 14/1, 2006, pp. 37-48.
Stewart M. et al., "polysilicon TFT technology for active matrix oled displays" IEEE transactions on electron devices, vol. 48, No. 5, dated May 2001 (7 pages).
Vygranenko et al.: "Stability of indium-oxide thin-film transistors by reactive ion beam assisted deposition"; dated 2009.
Wang et al.: "Indium oxides by reactive ion beam assisted evaporation: From material study to device application"; dated Mar. 2009 (6 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.
Yu, Jennifer: "Improve OLED Technology for Display", Ph.D. Dissertation, Massachusetts Institute of Technology, Sep. 2008 (151 pages).
International Search Report for Application No. PCT/IB2014/058244, Canadian Intellectual Property Office, dated Apr. 11, 2014; (6 pages).
International Search Report for Application No. PCT/IB2014/059753, Canadian Intellectual Property Office, dated Jun. 23, 2014; (6 pages).
Written Opinion for Application No. PCT/IB2014/059753, Canadian Intellectual Property Office, dated Jun. 12, 2014 (6 pages).
Written Opinion for Application No. PCT/IB2014/060879, Canadian Intellectual Property Office, dated Jul. 17, 2014 (3 pages).

(56) References Cited

OTHER PUBLICATIONS

Extended European Search Report for Application No. EP 14158051.4, dated Jul. 29, 2014, (4 pages).

* cited by examiner

COMPENSATION TECHNIQUE FOR LUMINANCE DEGRADATION IN ELECTRO-LUMINANCE DEVICES

CROSS REFERENCE TO RELATED APPLICATIONS

This application is a continuation of prior U.S. application Ser. No. 12/965,610, filed Dec. 10, 2010, now allowed, which is a continuation of prior U.S. application Ser. No. 11/519,338, filed Sep. 12, 2006, now issued as U.S. Pat. No. 8,188,946, which claims the benefit of Canadian Patent No. 2,518,276, filed Sep. 13, 2005, each of which is hereby incorporated by reference herein in its entirety.

FIELD OF INVENTION

The present invention relates to electro-luminance device displays, and more specifically to a driving technique for the electro-luminance device displays to compensate for luminance degradation.

BACKGROUND OF THE INVENTION

Electro-luminance displays have been developed for a wide variety of devices, such as cell phones. In particular, active-matrix organic light-emitting diode (AMOLED) displays with amorphous silicon (a-Si), poly-silicon, organic, or other driving backplane have become more attractive due to advantages, such as feasible flexible displays, its low cost fabrication, high resolution, and a wide viewing angle.

An AMOLED display includes an array of rows and columns of pixels, each having an organic light-emitting diode (OLED) and backplane electronics arranged in the array of rows and columns. Since the OLED is a current driven device, the pixel circuit of the AMOLED should be capable of providing an accurate and constant drive current.

There is a need to provide a method and system that is capable of providing constant brightness with high accuracy and reducing the effect of the aging of the pixel circuit.

SUMMARY OF THE INVENTION

It is an object of the invention to provide a method and system that obviates or mitigates at least one of the disadvantages of existing systems.

In accordance with an aspect of the present invention there is provided a pixel circuit including a light emitting device and a storage capacitor having a first terminal and a second terminal. The pixel circuit includes a first transistor having a gate terminal, a first terminal and a second terminal where the gate terminal is connected to a first select line. The pixel circuit includes a second transistor having a gate terminal, a first terminal and a second terminal where the first terminal is connected to the second terminal of the first transistor, and the second terminal is connected to the light emitting device. The pixel circuit includes a third transistor having a gate terminal, a first terminal and a second terminal where the gate terminal is connected to a second select line, the first terminal is connected to the second terminal of the first transistor, and the second terminal is connected to the gate terminal of the second transistor and the first terminal of the storage capacitor. The pixel circuit includes a fourth transistor having a gate terminal, a first terminal and a second terminal where the gate terminal is connected to a third select line, the first terminal is connected to the second terminal of the storage capacitor, and the second terminal is connected to the second terminal of the second transistor and the light emitting device. The pixel circuit includes a fifth transistor having a gate terminal, a first terminal and a second terminal where the gate terminal is connected to the second select line, the first terminal is connected to a signal line, and the second terminal is connected to the first terminal of the forth transistor and the second terminal of the storage capacitor.

In the above pixel circuit, the third select line may be the first select line.

The above pixel circuit may include a sixth transistor having a gate terminal, a first terminal and a second terminal where the gate terminal is connected to the second select line, the first terminal is connected to the first terminal of the second transistor, and the second terminal is connected to a bias current line.

In accordance with a further of the present invention there is provided a display system including a display array formed by the pixel circuit, and a driving module for programming and driving the pixel circuit.

In accordance with a further of the present invention there is provided a method for compensating for degradation of the light emitting device in the pixel circuit. The method includes the steps of charging the storage capacitor and discharging the storage capacitor. The step of charging the storage capacitor includes connecting the storage capacitor to the signal line. The method includes the step of disconnecting the storage capacitor from the signal line and connecting the second terminal of the storage capacitor to the second terminal of the second transistor.

In accordance with a further of the present invention there is provided a method for compensating for shift in a threshold voltage of the transistor in the pixel circuit. The method includes the steps of charging the storage capacitor and discharging the storage capacitor. The step of charging the storage capacitor includes connecting the storage capacitor to the signal line. The method includes the step of disconnecting the storage capacitor from the signal line and connecting the second terminal of the storage capacitor to the second terminal of the second transistor.

In accordance with a further of the present invention there is provided a method for compensating for ground bouncing or IR drop in the pixel circuit. The method includes the steps of charging the storage capacitor and discharging the storage capacitor. The step of charging the storage capacitor includes connecting the storage capacitor to the signal line and the bias current line. The method includes the step of disconnecting the storage capacitor from the signal line and the bias current line and connecting the second terminal of the storage capacitor to the second terminal of the second transistor.

This summary of the invention does not necessarily describe all features of the invention.

BRIEF DESCRIPTION OF THE DRAWINGS

These and other features of the invention will become more apparent from the following description in which reference is made to the appended drawings wherein.

DETAILED DESCRIPTION

Embodiments of the present invention are described using a pixel circuit having a light emitting device, such as an organic light emitting diode (OLED), and a plurality of transistors. However, the pixel circuit may include any light emitting device other than the OLED. The transistors in the pixel circuit may be n-type transistors, p-type transistors or combinations thereof. The transistors in the pixel circuit may be fabricated using amorphous silicon, nano/micro crystalline silicon, poly silicon, organic semiconductors technologies (e.g. organic TFT), NMOS/PMOS technology or CMOS technology (e.g. MOSFET). A display having the pixel circuit may be a single color, multi-color or a fully color display, and may include one or more than one electroluminescence (EL) element (e.g., organic EL). The display may be an active matrix light emitting display. The display may be used in DVDs, personal digital assistants (PDAs), computer displays, or cellular phones.

In the description, "pixel circuit" and "pixel" may be used interchangeably. In the description below, "signal" and "line" may be used interchangeably. In the description below, "connect (or connected)"and "couple (or coupled)" may be used interchangeably, and may be used to indicate that two or more elements are directly or indirectly in physical or electrical contact with each other.

The embodiments of the present invention involve a driving method of driving the pixel circuit, which includes an in-pixel compensation technique for compensating for at least one of OLED degradation, backplane instability (e.g. TFT threshold shift), and ground bouncing (or IR drop). The driving scheme allows the pixel circuit to provide a stable luminance independent of the shift of the characteristics of pixel elements due to, for example, the pixel aging under prolonged display operation and process variation. This enhances the brightness stability of the OLED and efficiently improves the display operating lifetime.

Figure 1A:
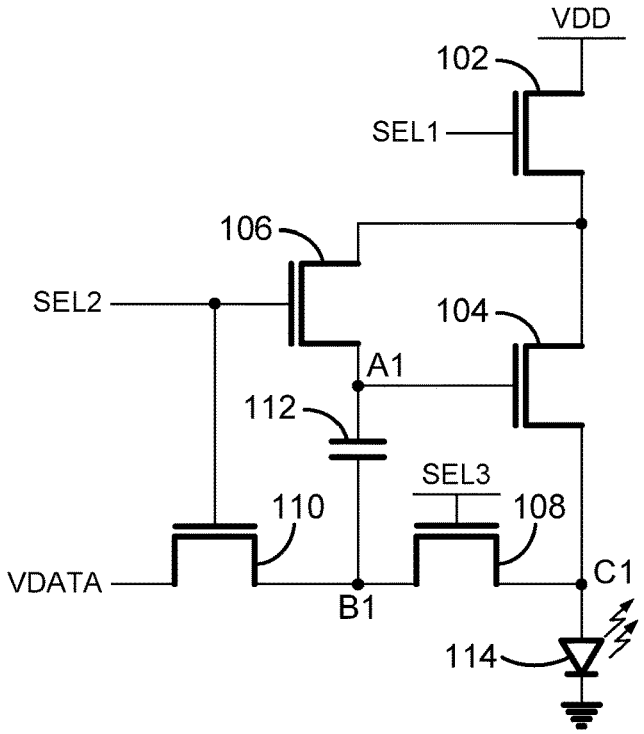
FIG. 1A is a diagram illustrating an example of a pixel circuit along with its control signal lines to which a pixel driving scheme in accordance with an embodiment of the present invention is applied.

FIG. 1A illustrates an example of a pixel circuit along with its control signal lines to which a pixel driving scheme in accordance with an embodiment of the present invention is applied. The pixel circuit 100 of FIG. 1A includes transistors 102-110, a storage capacitor 112 and an OLED 114. The pixel circuit 100 is connected to three select lines SEL1, SEL2, and SEL3, a signal line VDATA, a voltage line VDD, and a common ground.

The transistors 102-110 may be amorphous silicon, poly silicon, or organic thin-film transistors (TFT) or standard NMOS in CMOS technology. It would be appreciated by one of ordinary skill in the art that the pixel circuit 100 can be rearranged using p-type transistors.

The transistor 104 is a driving transistor. The source and drain terminals of the driving transistor 104 are connected to the anode electrode of the OLED 114 and the source terminal of the transistor 102, respectively. The gate terminal of the driving transistor 104 is connected to the signal line VDATA through the transistor 110 and is connected to the source terminal of the transistor 106. The drain terminal of the transistor 106 is connected to the source terminal of the transistor 102 and its gate terminal is connected to the select line SEL2.

The drain terminal of the transistor 108 is connected to the source terminal of the transistor 110, its source terminal is connected to the anode of the OLED 114, and its gate terminal is connected to the select line SEL3.

The drain terminal of the transistor 110 is connected to the signal line VDATA, and its gate terminal is connected to the select line SEL2.

The driving transistor 104, the transistor 106 and the storage capacitor 112 are connected at node A1. The transistors 108 and 110 and the storage capacitor 112 are connected at node B1.

Figure 1B:
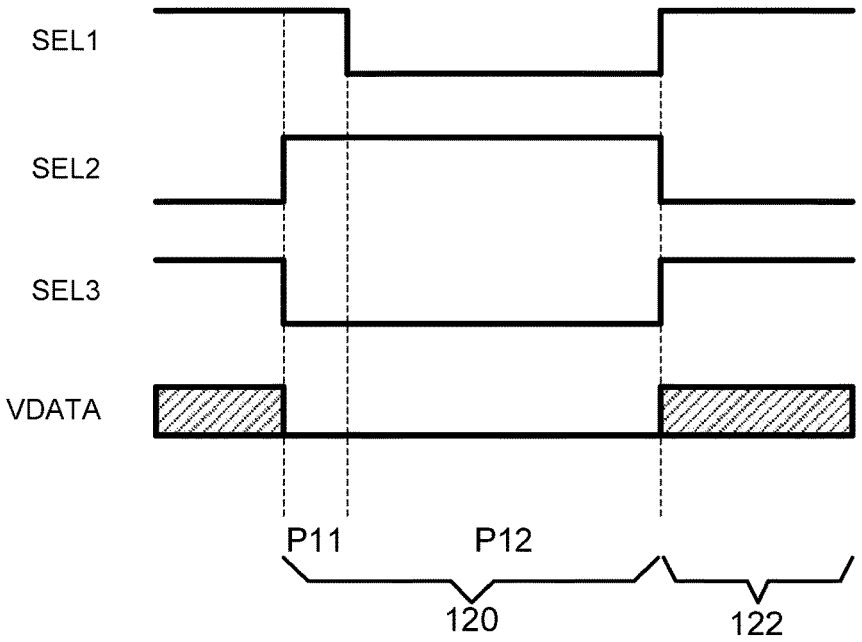
FIG. 1B is a timing diagram illustrating an example of a method of operating the pixel circuit of FIG. 1A.

FIG. 1B illustrates an example of a method of operating the pixel circuit 100 of FIG. 1A. The pixel circuit 100 of FIG. 1 A includes n-type transistors. However, it would be understood by one of ordinary skill in the art that the method of FIG. 1B is applicable to a pixel circuit having p-type transistors.

Referring to FIGS. 1A-1B, the operation of the pixel circuit 100 includes two operating cycles: programming cycle 120 and driving cycle 122. At the end of the programming cycle 120, node A1 is charged to $(V_P+V_T+\Delta V_{OLED})$ where $V_P$ is a programming voltage, $V_T$ is the threshold voltage of the transistor 104, and $\Delta V_{OLED}$ is the OLED voltage shift under bias stress.

The programming cycle 120 includes two sub-cycles: pre-charging P11 and compensation P12, hereinafter referred to as pre-charging sub-cycle P11 and compensation sub-cycle P12, respectively.

During the pre-charging sub-cycle P11, the select lines SEL1 and SEL2 are high and SEL3 is low, resulting in turning the transistors 102, 106 and 110 on, and the transistor 108 off respectively. The voltage at VDATA is set to $(V_{OLEDi}-V_P)$. "$V_P$" is a programming voltage. "i" represents initial voltage of OLED. "$V_{OLEDi}$" is a constant voltage and can be set to the initial ON voltage of the OLED 114. However, $V_{OLEDi}$ can be set to other voltages such as zero. At the end of the pre-charging sub-cycle P11, the storage capacitor 112 is charged with a voltage close to $(VDD+V_P-V_{OLEDi})$.

During the compensation sub-cycle P12, the select line SEL2 is high so that the transistors 106 and 110 are on, and the select lines SEL1 and SEL3 are low so that the transistors 102 and 108 are off. As a result, the storage capacitor 112 starts discharging through the transistor 104 and the OLED 114 until the current through the driving transistor 104 and the OLED 114 becomes close to zero. Consequently, the voltage close to $(V_T+V_P+V_{OLED}-V_{OLEDi})$ is stored in the storage capacitor 112 where $V_{OLED}$ is the ON voltage of the OLED 114.

During the driving cycle 122, the select line SEL2 is low so that the transistors 106 and 110 are off, and the select lines SEL1 and SEL3 are high so that the transistors 102 and 108 are on. As a result, the storage capacitor 112 is disconnected from the signal line VDATA and is connected to the source of the driving transistor 104.

If the driving transistor 104 is in saturation region, a current close to $K(V_P+\Delta V_{OLED})^2$ goes through the OLED 114 until the next programming cycle where K is the trans-conductance coefficient of the driving transistor 104, and $\Delta V_{OLED}=V_{OLED}-V_{OLEDi}$).

Figure 2:
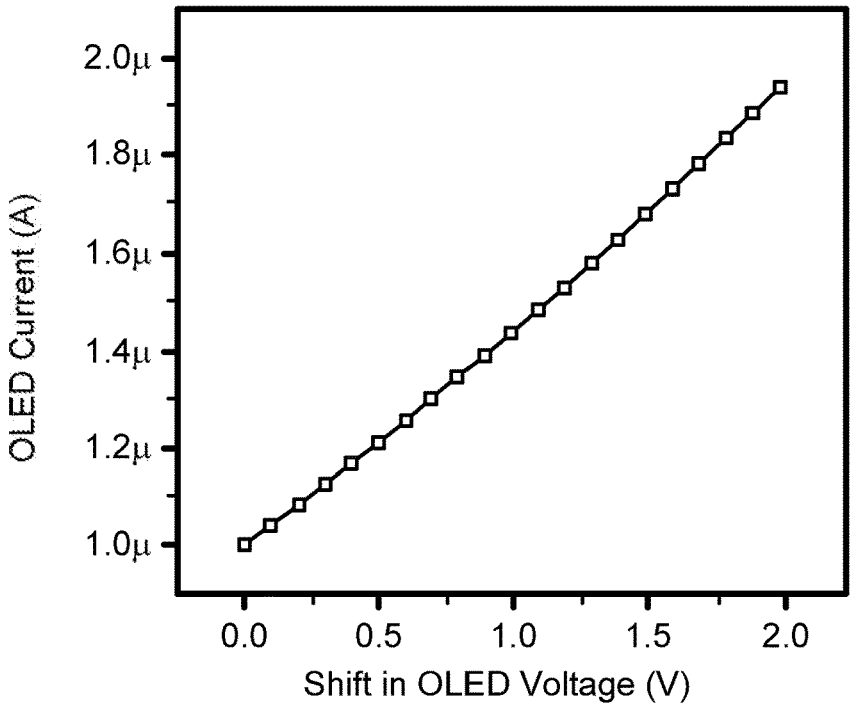
FIG. 2 is a graph illustrating a simulation result for FIGS. 1A-1B.

FIG. 2 illustrates an example of a simulation result for the operation of FIGS. 1A-1B. The graph of FIG. 2 represents OLED current during the driving cycle 122 as a function of shift in its voltage. Referring to FIGS. 1A, 1B and 2, it can be seen that as $\Delta V_{OLED}$ increases over time, the driving current of the OLED 114 is also increased. Thus, the pixel circuit 100 compensates for luminance degradation of the OLED 114 by increasing the driving current of the OLED 114.

Figure 3:
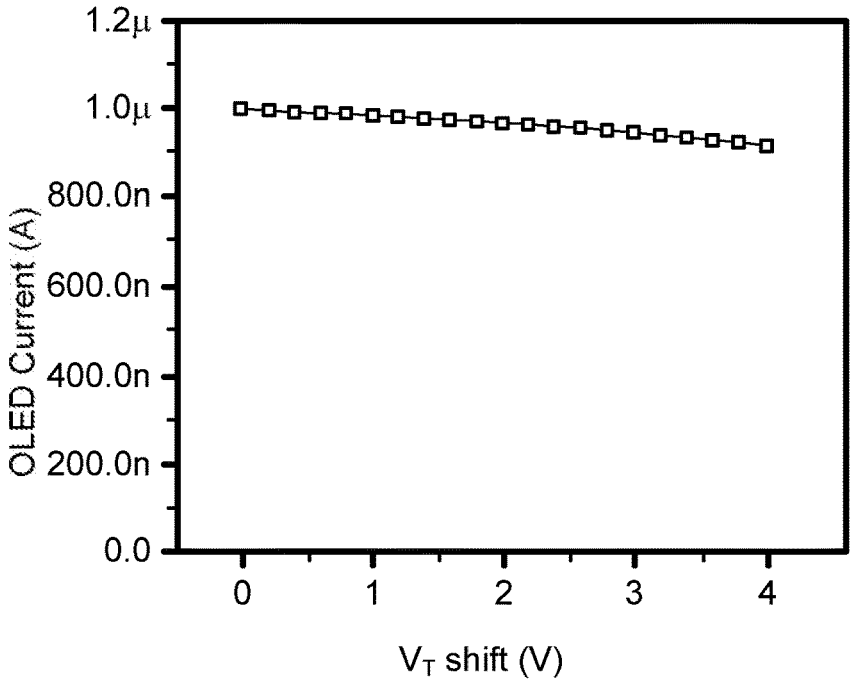
FIG. 3 is a graph illustrating another simulation result for FIGS. 1A-1B.

FIG. 3 illustrates an example of another simulation result for the operation of FIGS. 1A-1B. The graph of FIG. 3 represents OLED current during the driving cycle 122 as a function of shift in the threshold voltage of the driving transistor 104. Referring to FIGS. 1A, 1B and 3, the pixel circuit 100 compensates for shift in the threshold voltage of the driving transistor 104 since the driving current of the OLED 114 is independent of the threshold of the driving transistor 104. The result as shown in FIG. 3 emphasizes the OLED current stability for 4–V shift in the threshold of the driving transistor.

Figure 4A:
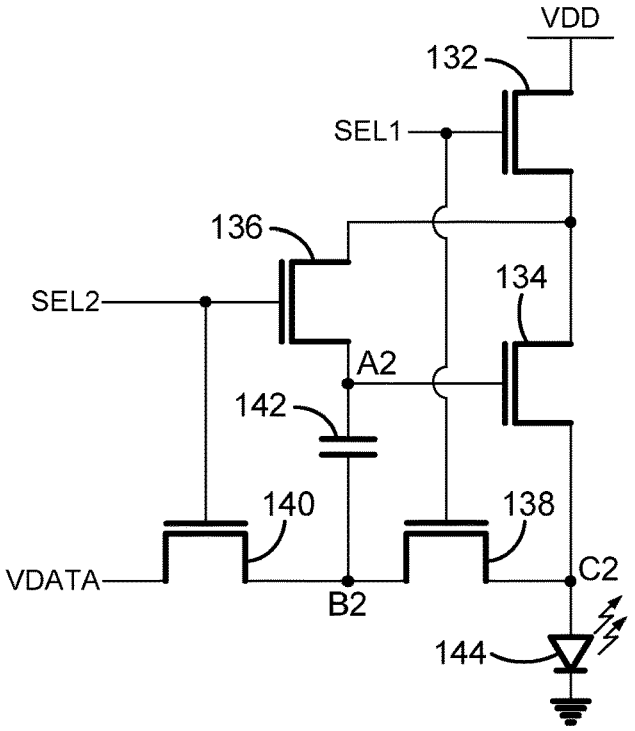
FIG. 4A is a diagram illustrating an example of a pixel circuit along with its control signal lines to which the pixel driving scheme in accordance with another embodiment of the present invention is applied.

FIG. 4A illustrates an example of a pixel circuit along with its control signal lines to which the pixel driving scheme in accordance with another embodiment of the present invention is applied. The pixel circuit 130 of FIG. 4A includes five transistors 132-140, a storage capacitor 142 and an OLED 144. The pixel circuit 130 is connected to two select lines SEL1 and SEL2, a signal line VDATA, a voltage line VDD, and a common ground.

The transistors 132-140 may be same or similar to the transistors 102-110 of FIG. 1A. The transistors 132-140 may be amorphous silicon, poly silicon, or organic TFT or standard NMOS in CMOS technology. The storage capacitor 142 and the OLED 140 are same or similar to the storage capacitor 112 and the OLED 114 of FIG. 1A, respectively.

The transistor 134 is a driving transistor. The source and drain terminals of the driving transistor 134 are connected to the anode electrode of the OLED 144 and the source of the transistor 132, respectively. The gate terminal of the driving transistor 134 is connected to the signal line VDATA through the transistor 140, and is connected to the source terminal of the transistor 136. The drain terminal of the transistor 136 is connected to the source terminal of the transistor 132 and its gate terminal is connected to the select line SEL2.

The drain terminal of the transistor 138 is connected to the source terminal of the transistor 140, its source terminal is connected to the anode of the OLED 144, and its gate terminal is connected to the select line SEL1.

The drain terminal of the transistor 140 is connected to the signal line VDATA, and its gate terminal is connected to the select line SEL2.

The driving transistor 134, the transistor 136 and the storage capacitor 142 are connected at node A2. The transistors 138 and 140 and the storage capacitor 142 are connected at node B2.

Figure 4B:
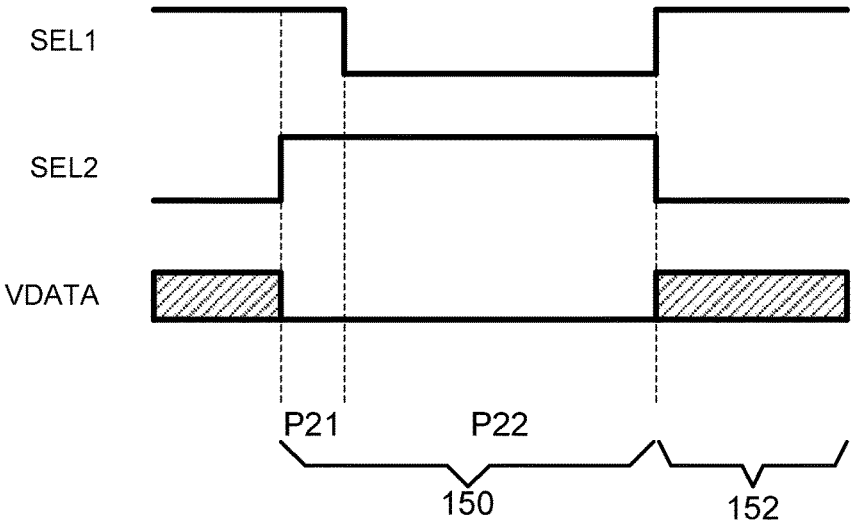
FIG. 4B is a timing diagram illustrating an example of a method of operating the pixel circuit of FIG. 4A.

FIG. 4B illustrates an example of a method of operating the pixel circuit 130 of FIG. 4A. The pixel circuit 130 of FIG. 4A includes n-type transistors. However, it would be understood by one of ordinary skill in the art that the method of FIG. 4B is applicable to a pixel circuit having p-type transistors.

Referring to FIGS. 4A-4B, the operation of the pixel circuit 130 includes two operating cycles: programming cycle 150 and driving cycle 152. At the end of the programming cycle 150, node A2 is charged to $(V_P+V_T+\Delta V_{OLED})$ where $V_P$ is a programming voltage, $V_T$ is the threshold voltage of the transistor 134, and $\Delta V_{OLED}$ is the OLED voltage shift under bias stress.

The programming cycle 150 includes two sub-cycles: pre-charging P21 and compensation P22, hereinafter referred to as pre-charging sub-cycle P21 and compensation sub-cycle P22, respectively.

During the pre-charging sub-cycle P21, the select lines SEL1 and SEL2 are high, and VDATA goes to a proper voltage $V_{OLEDi}$ that turns off the OLED 144. $V_{OLEDi}$ is a predefined voltage which is less than minimum ON voltage of the OLEDs. At the end of the pre-charging sub-cycle P21, the storage capacitor 142 is charged with a voltage close to $(VDD+V_{OLEDi})$. The voltage at VDATA is set to $(V_{OLEDi}-V_P)$ where $V_P$ is a programming voltage.

During the compensation sub-cycle P22, the select line SEL2 is high so that the transistors 136 and 140 are on, and the select line SEL1 is low so that the transistors 132 and 138 are off. The voltage of VDATA at P22 is different from that of P21 to properly charge A2 to $(V_P+V_T+\Delta V_{OLED})$ at the end of P22. As a result, the storage capacitor 142 starts discharging through the driving transistor 134 and the OLED 144 until the current through the driving transistor 134 and the OLED 144 becomes close to zero. Consequently, the voltage close to $(V_T+V_P+V_{OLED}-V_{OLEDi})$ is stored in the storage capacitor 142 where $V_{OLED}$ is the ON voltage of the OLED 144.

During the driving cycle 152, the select SEL2 is low, resulting in turning the transistors 136 and 140 off. The select line SEL1 is high, resulting in turning the transistors 132 and 138 on. As a result, the storage capacitor 142 is disconnected from the signal line VDATA and is connected to the source terminal of the driving transistor 134

If the driving transistor 134 is in saturation region, a current close to $K(V_P+\Delta V_{OLED})^2$ goes through the OLED 144 until the next programming cycle where K is the trans-conductance coefficient of the driving transistor 134, and $\Delta V_{OLED}=V_{OLED}-V_{OLEDi}$. As a result, the driving current of the OLED 144 increases, as the $\Delta V_{OLED}$ increases over time. Thus, the pixel circuit 130 compensates for luminance degradation of the OLED 144 by increasing the driving current of the OLED 144.

Moreover, the pixel circuit 130 compensates for shift in threshold voltage of the driving transistor 134 and so the driving current of the OLED 144 is independent of the threshold $V_T$.

Figure 5A:
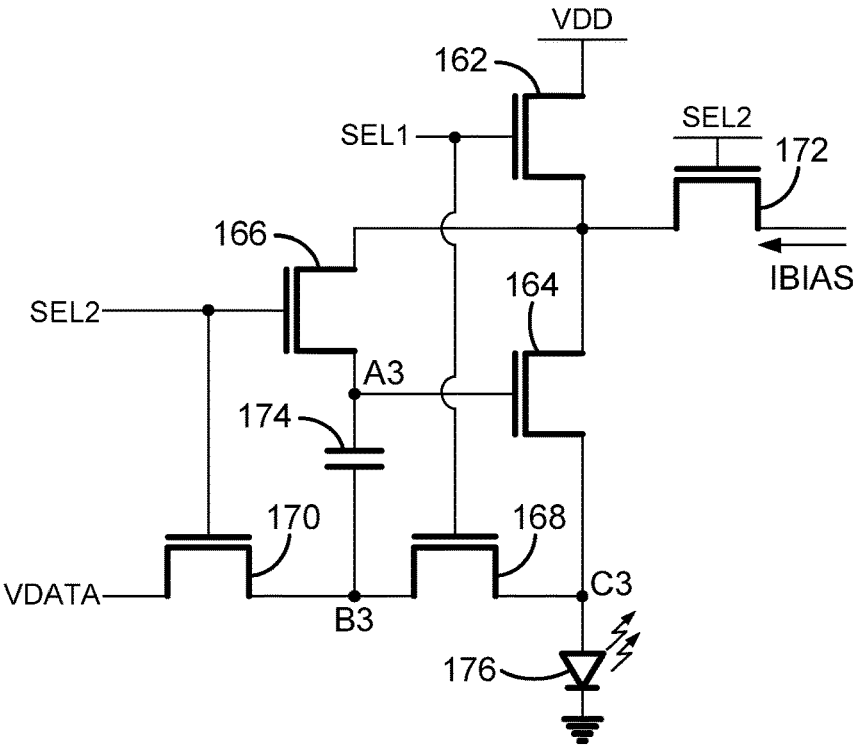
FIG. 5A is a diagram illustrating an example of a pixel circuit along with its control signal lines to which the pixel driving scheme in accordance with a further embodiment of the present invention is applied.

FIG. 5A illustrates an example of a pixel circuit along with its control signal lines to which the pixel driving scheme in accordance with a further embodiment of the present invention is applied. The pixel circuit 160 of FIG. 5A includes six transistors 162-172, a storage capacitor 174 and an OLED 176. The pixel circuit 160 is connected to two select lines SEL1 and SEL2, a signal line VDATA, a voltage line VDD, a bias current line IBIAS, and a common ground.

The transistors 162-172 may be amorphous silicon, poly silicon, or organic TFT or standard NMOS in CMOS technology. The storage capacitor 174 and the OLED 176 are same or similar to the storage capacitor 112 and the OLED 114 of FIG. 1A, respectively.

The transistor 164 is a driving transistor. The source and drain terminals of the driving transistor 164 are connected to the anode electrode of the OLED 176 and the source terminal of the transistor 162, respectively. The gate terminal of the driving transistor 164 is connected to the signal line VDATA through the transistor 170 and is connected to the source terminal of the transistor 166. The drain terminal of the transistor 166 is connected to the source terminal of the transistor 162 and its gate terminal is connected to the select line SEL2.

The drain terminal of the transistor 168 is connected to the source terminal of the transistor 170, its source terminal is connected to the anode of the OLED 176, and its gate terminal is connected to the select line SEL1 .

The drain terminal of the transistor 170 is connected to VDATA, and its gate terminal is connected to the select line SEL2.

The drain terminal of the transistor 172 is connected to the bias line IBIAS, its gate terminal is connected to the select line SEL2, and its source terminal is connected to the source terminal of the transistor 162 and the drain terminal of the transistor 164.

The driving transistor 164, the transistor 166 and the storage capacitor 174 are connected at node A3. The transistors 168 and 170 and the storage capacitor 174 are connected at node B3.

Figure 5B:
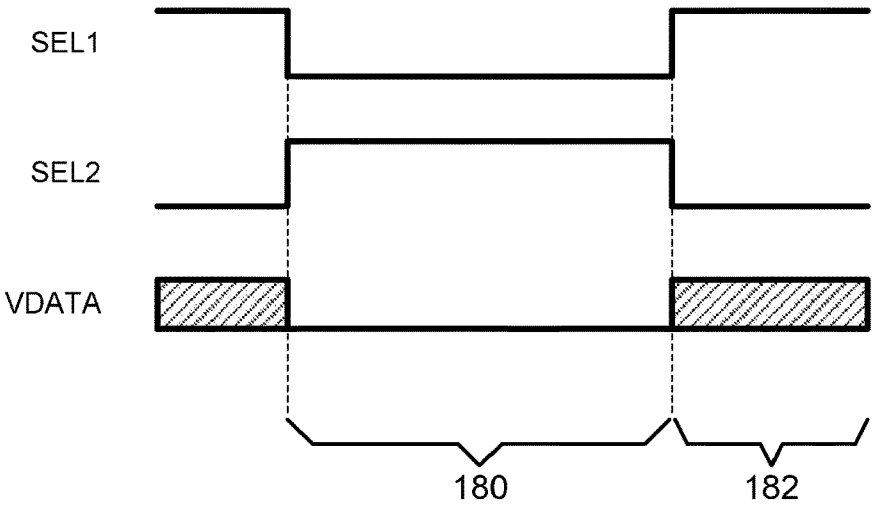
FIG. 5B is a timing diagram illustrating an example of a method of operating the pixel circuit of FIG. 5A.

FIG. 5B illustrates an example of a method of operating the pixel circuit 160 of FIG. 5A. The pixel circuit 160 of FIG. 5A includes n-type transistors. However, it would be understood by one of ordinary skill in the art that the method of FIG. 5B is applicable to a pixel circuit having p-type transistors.

Referring to FIGS. 5A-5B, the operation of the pixel circuit 160 includes two operating cycles: programming cycle 180 and driving cycle 182. At the beginning of the second operating cycle 182, node A3 is charged to ($V_P$+$V_T$+$\Delta V_{OLED}$) where $V_P$ is a programming voltage, $V_T$ is the threshold voltage of the transistor 164, and $\Delta V_{OLED}$ is the OLED voltage shift under bias stress. $V_T$ and $\Delta V_{OLED}$ are generated by large IBIAS resulting in a fast programming.

During the first operating cycle 180, the select line SEL1 is low, the select line SEL2 is high, and VDATA goes to a proper voltage ($V_{OLEDi}$−$V_P$) where $V_P$ is a programming voltage. This proper voltage is a predefined voltage which is less than minimum ON voltage of the OLEDs. Also, the bias line IBIAS provides bias current (referred to as $I_{BIAS}$) to the pixel circuit 160. At the end of this cycle node A3 is charged to $V_{BIAS}$+$V_T$+$V_{OLED}(I_{BIAS})$ where $V_{BIAS}$ is related to the bias current $I_{BIAS}$, and $V_{OLED}(I_{BIAS})$ is the OLED 176 voltage corresponding to $I_{BIAS}$. Voltage at node A3 is independent of $V_P$ at the end of 180. Charging to ($V_P$+$V_T$+$\Delta V_{OLED}$) happens at the beginning of 182.

During the second operating cycle 182, the select line SEL1 is high and the select line SEL2 is low. As a result node B3 is charged to $V_{OLED}(I_P)$ where $V_{OLED}(I_P)$ is the OLED 176 voltage corresponding to the pixel current. Thus, the gate-source voltage of the transistor 164 becomes ($V_P$+$\Delta V_{OLED}$+$V_T$) where $\Delta V_{OLED}$=$V_{OLED}(I_{BIAS})$−$V_{OLEDi}$. Since the OLED voltage increases for a constant luminance while its luminance decreases, the gate-source voltage of the transistor 164 increases resulting in higher OLED current. Consequently, the OLED 176 luminance remains constant.

Figure 6:
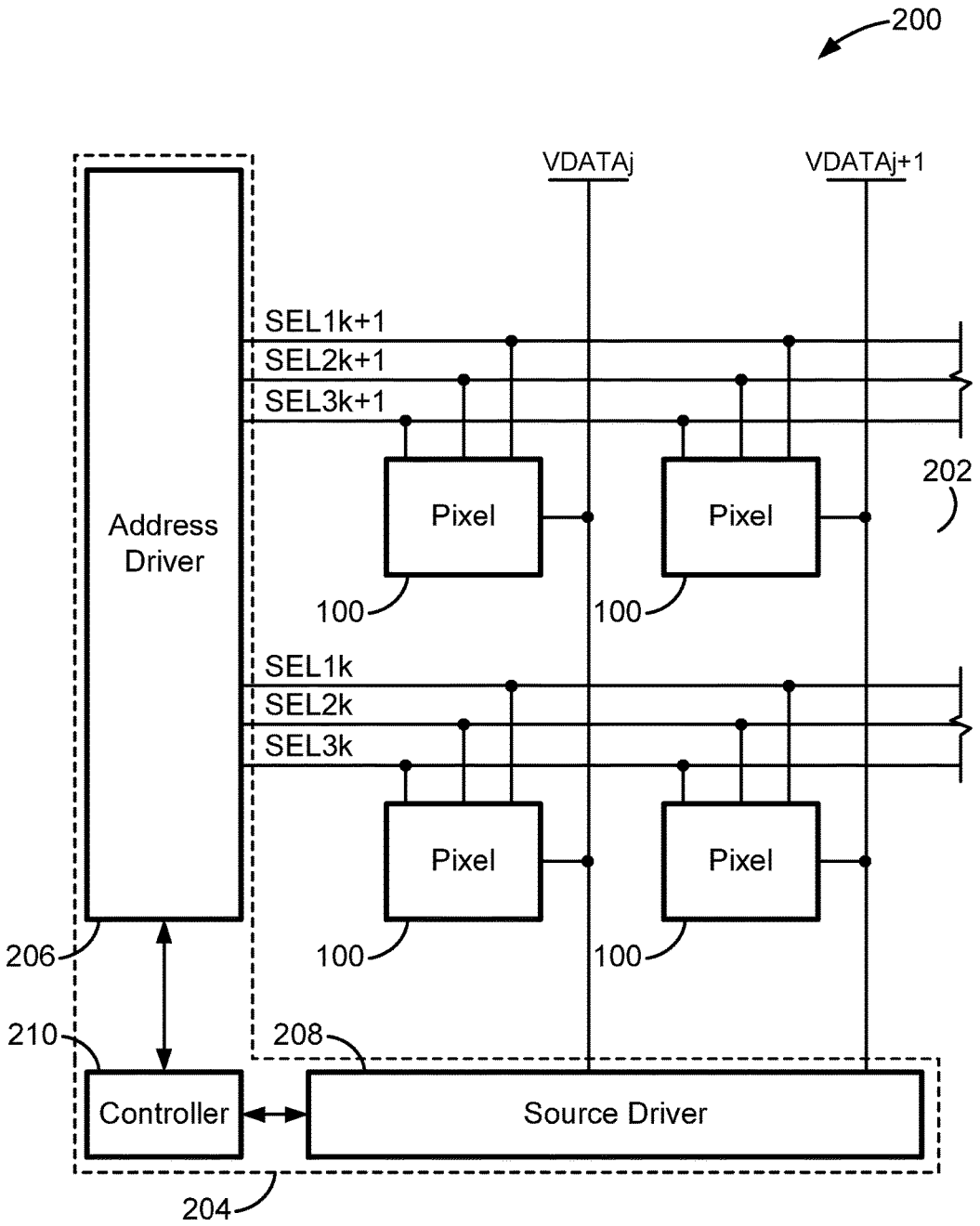
FIG. 6 is a diagram illustrating an example of a display system with a display array having the pixel circuit of FIG. 1A.

FIG. 6 illustrates an example of a display system 200 including the pixel circuit 100 of FIG. 1A. The display array 202 of FIG. 6 includes a plurality of pixel circuit 100 arranged in rows and columns, and may form an active matrix organic light emitting diode (AMOLED) display. VDATAj (j=1, 2, . . . ) corresponds to VDATA of FIG. 1A. SEL1*k*, SEL2*k* and SEL3*k* (k=1, 2, . . . ) correspond to SEL1, SEL2 and SEL3 of FIG. 1A, respectively. The select lines SEL1*k*, SEL2*k* and SEL3*k* are shared among the pixels in the common row of the display array 202. The signal line VDATAj is shared among the pixels in the common column of the display array 202.

The display system 200 includes a driving module 204 having an address driver 206, a source driver 208, and a controller 210. The select lines SEL1*k*, SEL2*k* and SEL3*k* are driven by the address driver 206. The signal line VDATAj is driven by the source driver 208. The controller 210 controls the operation of the address driver 206 and the source driver 208 to operate the display array 202.

The waveforms shown in FIG. 1B are generated by the driving module 204. The driver module 204 also generate the programming voltage. The compensation for OLED degradation, threshold voltage shift and ground bouncing occur in pixel. During the third cycle (122 of FIG. 1B), the gate-source voltage of the driving transistor is defined by the voltage stored in the storage capacitor (112 of FIG. 1). Therefore, the ground bouncing does not change the gate-source voltage and so the pixel current become stable.

Figure 7:
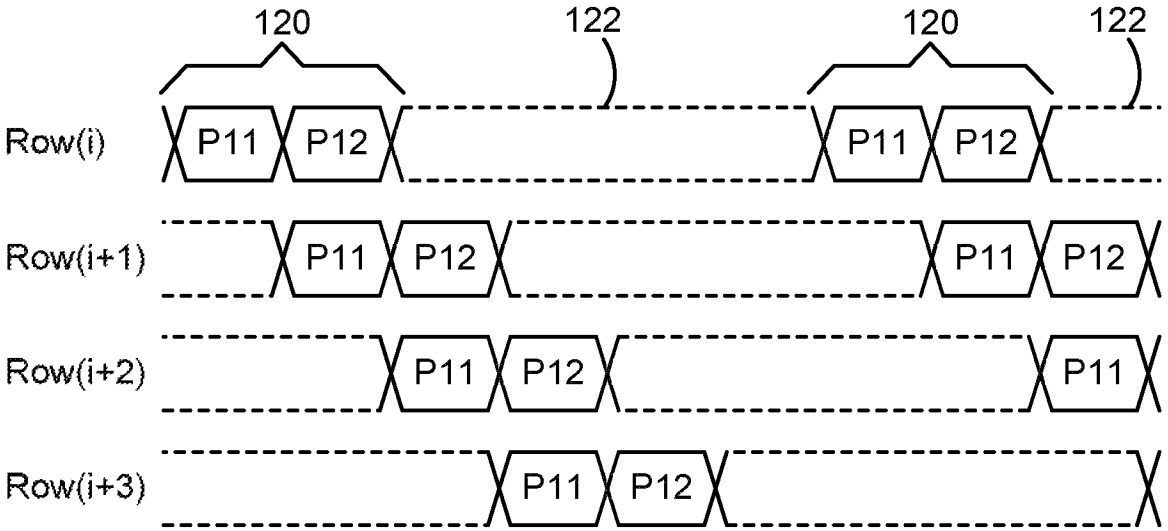
FIG. 7 is a timing diagram illustrating an example of a method of operating the display array of FIG. 6.

FIG. 7 illustrates an example of a method of operating the display array of FIG. 6. an example of In FIG. 7, Row(i) (i=1, 2, . . . ) represents a row of the display array 202 of FIG. 6. "120" and "122" in FIG. 7 represent "programming cycle" and "driving cycle" and correspond to those of FIG. 1B, respectively. "P11" and "P12" in FIG. 7 represent "pre-charging sub-cycle" and "compensation sub-cycle" and correspond to those of FIG. 1B, respectively. The compensation sub-cycle P11 in a row and the pre-charging sub-cycle P12 in an adjacent row are performed in parallel. Further, during the driving cycle 122 in a row, the compensation sub-cycle P22 is performed in an adjacent row. The display system 200 of FIG. 6 is designed to implement the parallel operation, i.e., having capability of carrying out different cycles independently without affecting each other.

Figure 8:
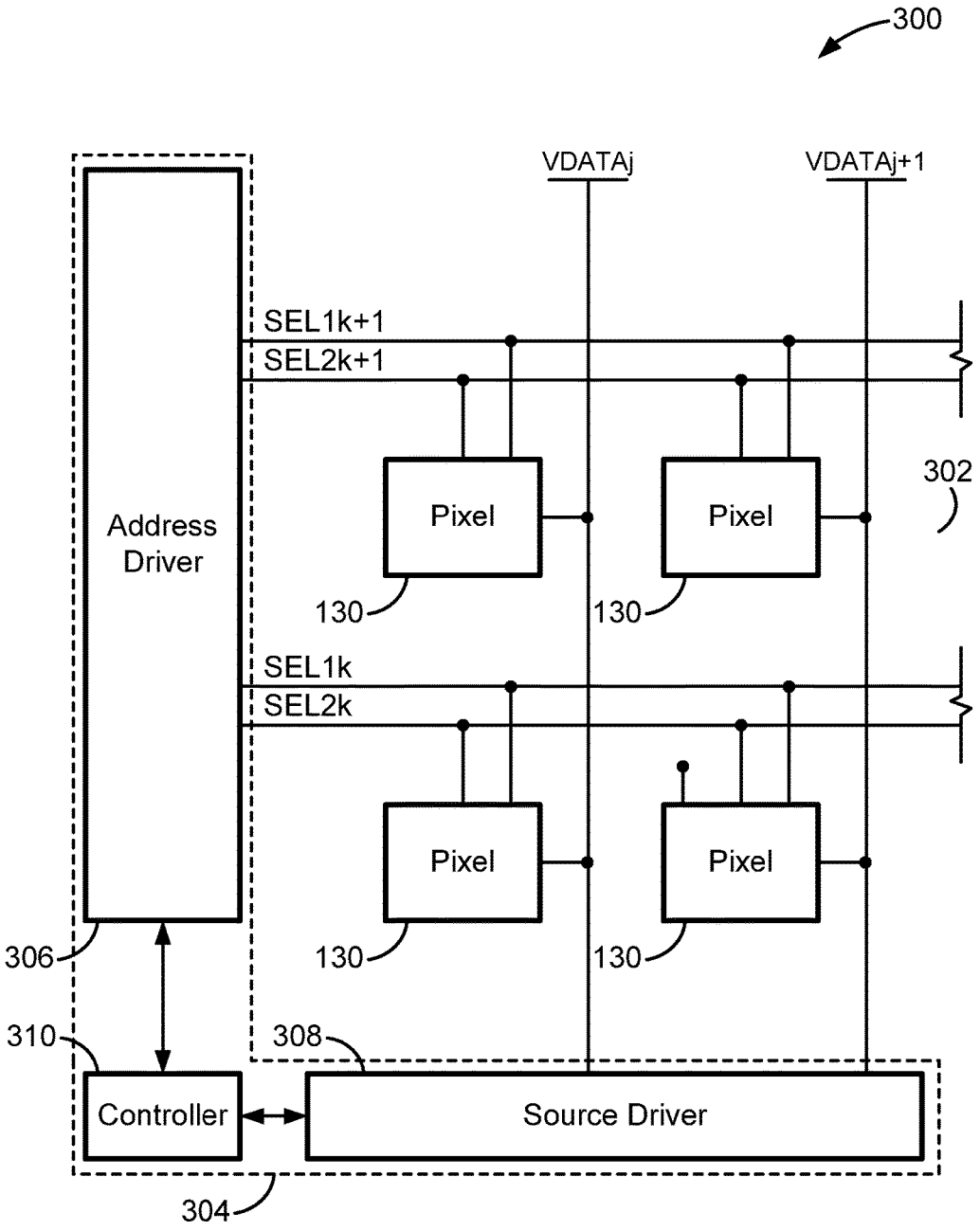
FIG. 8 is a diagram illustrating an example of a display system with a display array having the pixel circuit of FIG. 4A.

FIG. 8 illustrates an example of a display system 300 including the pixel circuit 130 of FIG. 4A. The display array 302 of FIG. 8 includes a plurality of pixel circuit 130 arranged in rows and columns, and may form an AMOLED display. VDATAj (j=1, 2, . . . ) corresponds to VDATA of FIG. 4A. SEL1*k* and SEL2*k* (k=1, 2, . . . ) correspond to SEL1 and SEL2 of FIG. 4A, respectively. The select lines SEL1*k* and SEL2*k* are shared among the pixels in the common row of the display array 302. The signal line VDATAj is shared among the pixels in the common column of the display array 302.

The display system 300 includes a driving module 304 having an address driver 306, a source driver 308, and a controller 310. The select lines SEL1*k* and SEL2*k* are driven by the address driver 306. The signal line VDATAj is driven by the source driver 308. The controller 310 controls the operation of the address driver 306 and the source driver 308 to operate the display array 302.

The waveforms shown in FIG. 4B are generated by the driving module 304. The driver module 304 also generates the programming voltage. The compensation for OLED degradation, threshold voltage shift and ground bouncing occur in pixel. During the third cycle (152 of FIG. 4B), the gate-source voltage of the driving transistor is defined by the voltage stored in the storage capacitor (142 of FIG. 4A). Therefore, the ground bouncing does not change the gate-source voltage and so the pixel current become stable.

Figure 9:
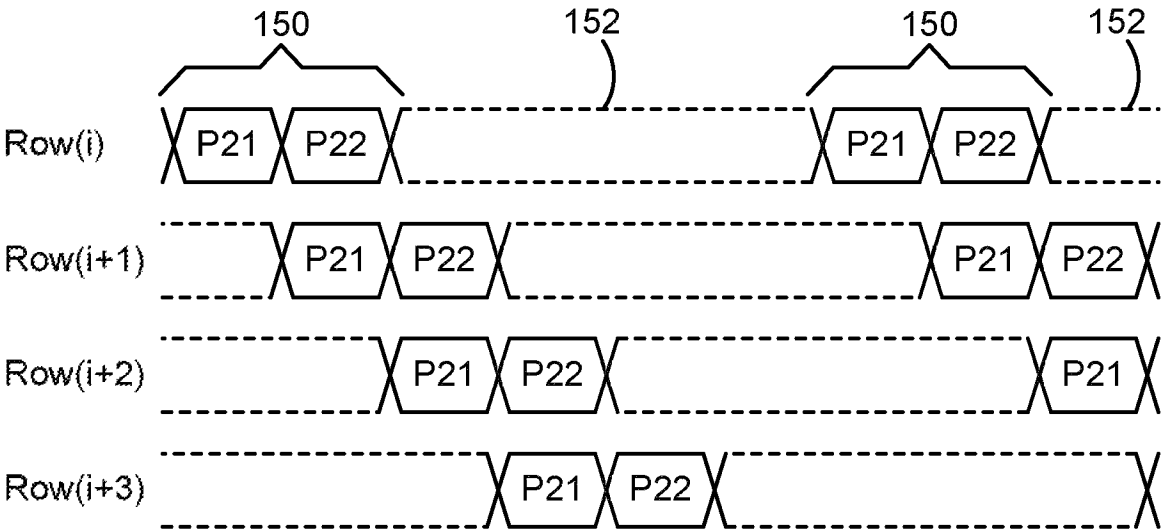
FIG. 9 is a timing diagram illustrating an example of a method of operating the display array of FIG. 8.

FIG. 9 illustrates an example of a method of operating the display array of FIG. 8. an example of In FIG. 9, Row(i) (i=1, 2, . . . ) represents a row of the display array 302 of FIG. 8. "150" and "152" in FIG. 9 represent "programming cycle" and "driving cycle" and correspond to those of FIG. 4B, respectively. "P21" and "P22" in FIG. 9 represent "pre-charging sub-cycle" and "compensation sub-cycle" and correspond to those of FIG. 4B, respectively. The compensation sub-cycle P21 in a row and the pre-charging sub-cycle P22 in an adjacent row are performed in parallel. Further, during the driving cycle 152 in a row, the compensation sub-cycle P22 is performed in an adjacent row. The display system 300 of FIG. 8 is designed to implement the parallel operation, i.e., having capability of carrying out different cycles independently without affecting each other.

Figure 10:
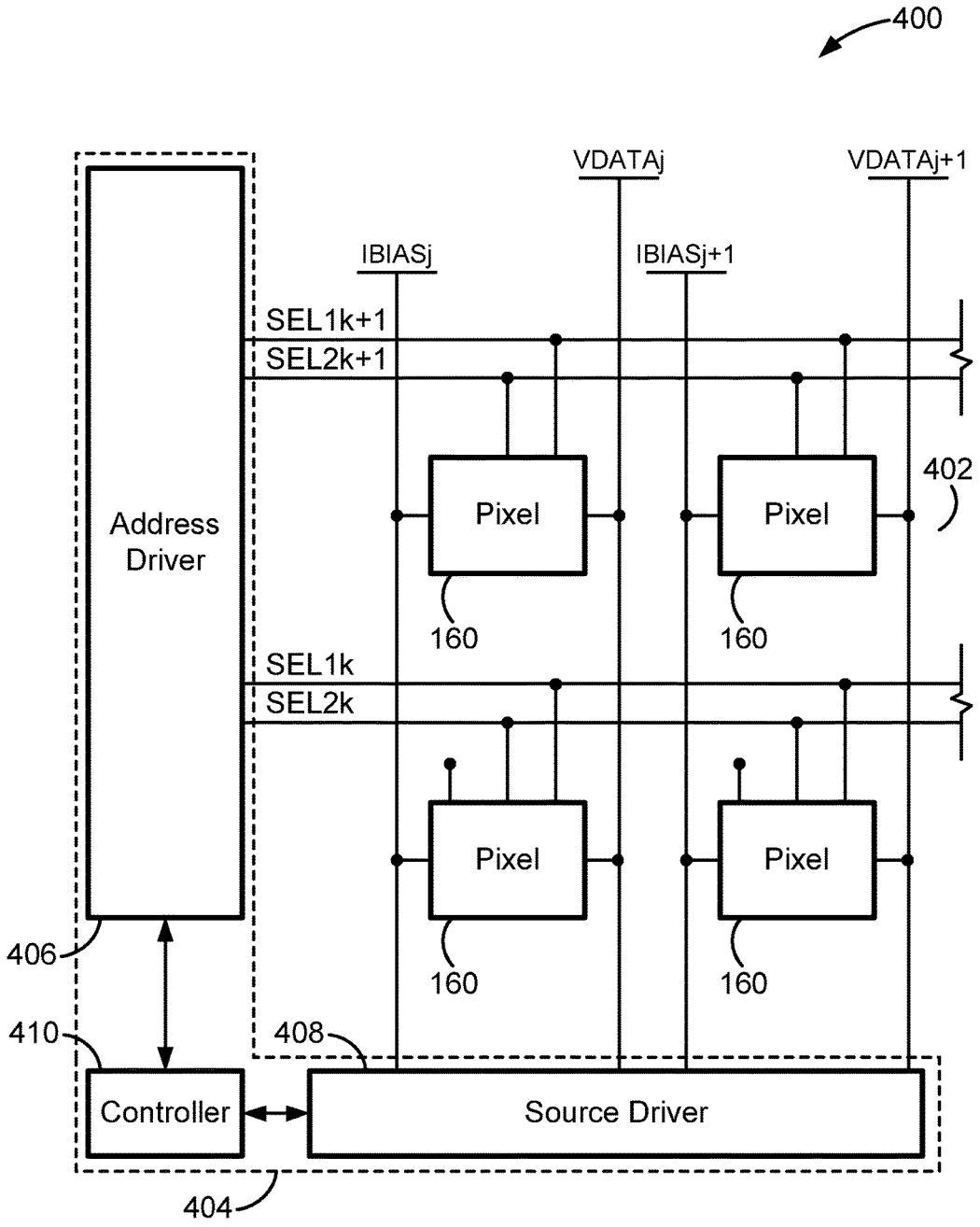
FIG. 10 is a diagram illustrating an example of a display system with a display array having the pixel circuit of FIG. 5A.

FIG. 10 illustrates an example of a display system 400 including the pixel circuit 160 of FIG. 5A. The display array 402 of FIG. 10 includes a plurality of pixel circuit 160 arranged in rows and columns, and is an AMOLED display. The display array 402 may be an AMOLED display. VDATAj (j=1, 2, . . . ) corresponds to VDATA of FIG. 4A. IBIASj (j=1, 2, . . . ) corresponds to IBIAS of FIG. 4A. SEL1*k* and SEL2*k* (k=1, 2, . . . ) correspond to SEL1 and SEL2 of FIG. 4A, respectively. The select lines SEL1*k* and SEL2*k* are shared among the pixels in the common row of the display array 402. The signal line VDATAj and the bias line IBIASj are shared among the pixels in the common column of the display array 402.

The display system 400 includes a driving module 404 having an address driver 406, a source driver 408, and a controller 410. The select lines SEL1*k* and SEL2*k* are driven by the address driver 406. The signal line VDATAj and the bias line IBIASj are driven by the source driver 408. The controller 410 controls the operation of the address driver 406 and the source driver 408 to operate the display array 402.

The waveforms shown in FIG. 5B are generated by the driving module 404. The driver module 404 also generate the programming voltage. The compensation for OLED degradation, threshold voltage shift and ground bouncing occur in pixel. During the second cycle 182 of FIG. 5B, the gate-source voltage of the driving transistor is defined by the voltage stored in the storage capacitor (174 of FIG. 5A). Therefore, the ground bouncing does not change the gate-source voltage and so the pixel current become stable.

Figure 11:
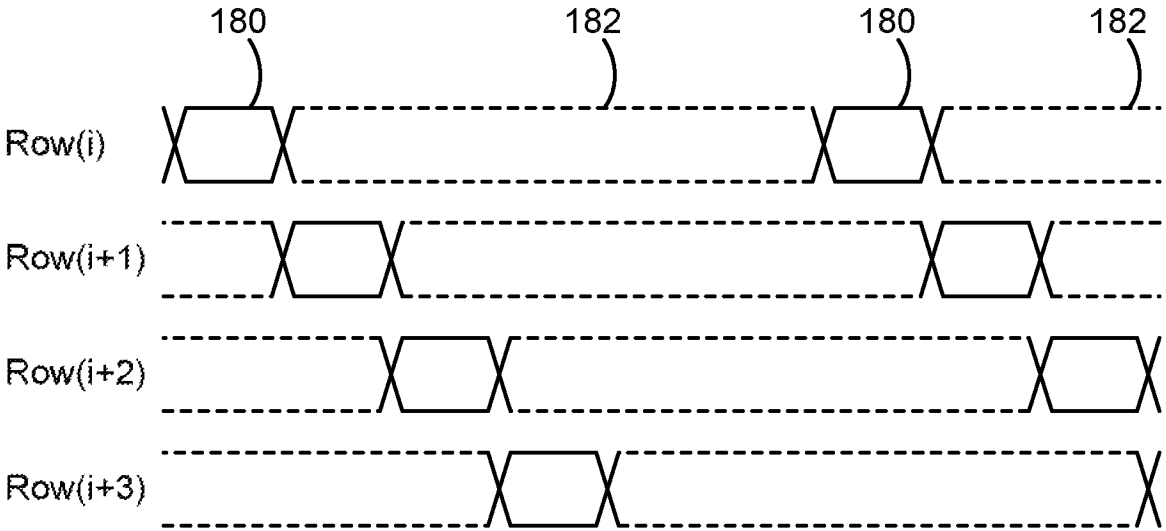
FIG. 11 is a timing diagram illustrating an example of a method of operating the display array of FIG. 10.

FIG. 11 illustrates an example of a method of operating the display array of FIG. 10. an example of In FIG. 9, Row(i) (i=1, 2, . . . ) represents a row of the display array 402 of FIG. 10. "180" and "182" in FIG. 11 correspond to those of FIG. 5B, respectively. For the rows of the display array 402, the programming cycle 180 is subsequently performed. During the driving cycle 182 in a row, the programming cycle 180 is performed in an adjacent row. The display system 400 of FIG. 10 is designed to implement the parallel operation, i.e., having capability of carrying out different cycles independently without affecting each other.

All citations are hereby incorporated by reference.

The present invention has been described with regard to one or more embodiments. However, it will be apparent to persons skilled in the art that a number of variations and modifications can be made without departing from the scope of the invention as defined in the claims.

What is claimed is:

1. A pixel circuit comprising:

a light emitting device having an initial ON voltage;

a power source for supplying a driving current to said light emitting device;

a driving transistor having a first terminal coupled to said power source and a second terminal coupled to said light emitting device, for supplying a driving current to the light emitting device during a driving cycle, the driving transistor also having a gate terminal, the driving transistor having a threshold voltage less than said initial ON voltage of said light emitting device;

a source of a programming voltage;

a storage capacitor having a first terminal coupled to said gate terminal of said driving transistor, and a second terminal coupled to said source of the programming voltage and to a node between said driving transistor and said light emitting device for charging to a voltage that is a function of said programming voltage and said initial ON voltage of said light emitting device during a programming cycle, so that the voltage between said gate terminal and said second terminal of said driving transistor is a function of said programming voltage and said initial ON voltage of said light emitting device, at said node between said driving transistor and said light emitting device, during a driving cycle.

2. The pixel circuit of claim 1, further comprising:

a second transistor for providing a discharging connection between the first terminal of the storage capacitor and a drain terminal of the driving transistor during the programming cycle according to a second voltage signal supplied, via a second select line, to a gate terminal of the second transistor, the discharging connection providing a path to partially discharge the storage capacitor through the driving transistor and the light emitting device during the programming cycle.

3. The pixel circuit of claim 1, wherein the storage capacitor is configured to be charged with said initial voltage during a pre-charging cycle having a duration less than a duration of the programming cycle, said initial voltage exceeding a compensated voltage, the compensated voltage being substantially the same as the sum of a programming voltage, a threshold voltage of the driving transistor, and a voltage drop of the light emitting device.

4. The pixel circuit of claim 3, wherein the storage capacitor is configured to partially discharge during a compensation cycle having a duration less than the duration of the programming cycle, until the storage capacitor is charged with the compensated voltage and the current through the driving transistor and the light emitting device is substantially zero.

5. The pixel circuit of claim 3, wherein the compensated voltage is stored in the storage capacitor at the conclusion of the pre-charging cycle, and wherein the pre-charging cycle precedes the driving cycle of the pixel circuit.

6. The pixel circuit of claim 1, wherein the light emitting device is configured to emit light responsive to the driving current flowing through the light emitting device, and wherein the driving current flowing through the light emitting device is controlled-according to the gate-source voltage of the driving transistor during the driving cycle.

7. The pixel circuit of claim 6, wherein the pixel circuit is configured to compensate for a shift in an on voltage of the light emitting device by allowing the storage capacitor to partially discharge through the light emitting device during the programming cycle such that the gate-source voltage of the driving transistor during the driving cycle accounts for the on voltage of the light emitting device.

8. The pixel circuit of claim 6, wherein the pixel circuit is configured to compensate for a shift in the threshold voltage of the driving transistor by allowing the storage capacitor to partially discharge through the driving transistor during the programming cycle such that the gate-source voltage of the driving transistor during the driving cycle accounts for the threshold voltage of the driving transistor.

9. The pixel circuit of claim 2, wherein the light emitting device is configured to emit light responsive to the driving current flowing through the light emitting device, and wherein the driving current flowing through the light emitting device is controlled according to the gate-source voltage of the driving transistor during the driving cycle.

10. The pixel circuit of claim 9, wherein the pixel circuit is configured to compensate for a shift in an on voltage of the light emitting device by allowing the storage capacitor to partially discharge via the discharging connection during the programming cycle such that the gate-source voltage of the driving transistor during the driving cycle accounts for the on voltage of the light emitting device.

11. The pixel circuit of claim 9, wherein the pixel circuit is configured to compensate for a shift in the threshold voltage of the driving transistor by allowing the storage capacitor to partially discharge via the discharging connection during the programming cycle such that the gate-source voltage of the driving transistor during the driving cycle accounts for the threshold voltage of the driving transistor.

12. The pixel circuit of claim 1, wherein the light emitting device is an organic light emitting diode.

13. The pixel circuit of claim 1, wherein the pixel circuit is incorporated in an active matrix organic light emitting diode display.

* * * * *